US010875705B2

(12) United States Patent
Wallenius et al.

(10) Patent No.: US 10,875,705 B2
(45) Date of Patent: Dec. 29, 2020

(54) TRANSPORT PACKAGE FOR INDIVIDUAL PACKAGES OF ABSORBENT TISSUE PAPER MATERIAL

(71) Applicant: SCA HYGIENE PRODUCTS AB, Gothenburg (SE)

(72) Inventors: Hans Wallenius, Gothenburg (SE); Fredrik Welander, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 16/060,758

(22) PCT Filed: Dec. 18, 2015

(86) PCT No.: PCT/SE2015/051373
§ 371 (c)(1),
(2) Date: Jun. 8, 2018

(87) PCT Pub. No.: WO2017/105309
PCT Pub. Date: Jun. 22, 2017

(65) Prior Publication Data

US 2018/0370718 A1 Dec. 27, 2018

(51) Int. Cl.
*B65D 85/62* (2006.01)
*B65D 85/07* (2017.01)
(Continued)

(52) U.S. Cl.
CPC ..... *B65D 85/62* (2013.01); *B65D 71/063* (2013.01); *B65D 85/07* (2018.01); *A47K 10/20* (2013.01);
(Continued)

(58) Field of Classification Search
CPC ..... B65D 85/62; B65D 65/02; B65D 71/06; B65D 85/07; A47K 10/185; A47K 10/20; A47K 10/22
(Continued)

(56) References Cited

U.S. PATENT DOCUMENTS 3,986,611 A 10/1976 Dreher
4,799,593 A 1/1989 Lawrence
(Continued)

FOREIGN PATENT DOCUMENTS

AU 2015417375 B2 6/2017
CA 2 253 457 C 8/2003
(Continued)

OTHER PUBLICATIONS

Office Action dated Sep. 26, 2018, by the Australian Government/IP Australia in corresponding Australian Patent Application No. 2015417375, (3 pages).
(Continued)

*Primary Examiner* — Rafael A Ortiz
(74) *Attorney, Agent, or Firm* — Buchanan Ingersoll & Rooney P.C.

(57) ABSTRACT

A transport package including a compressible packaging and a packing configuration, the packing configuration including at least three individual stacks of absorbent tissue paper material, and the packaging maintaining said individual stacks in the packing configuration, the transport package forming a rectangular parallelepiped delimited by six outer surfaces, defining three transport package extensions extending along three perpendicular dimensions in space defining a length, a width, and a height of the transport package. A relative deformation of the transport package is defined for each of the three dimensions, being the relative shortening of the transport package extension along a
(Continued)

selected dimension when the entire transport package is compressed with a deformation pressure of 15 kPa between two outer surfaces and along the selected dimension, wherein, for said transport package, the relative deformation along at least two out of the three dimensions is less than 10%.

22 Claims, 10 Drawing Sheets

(51) Int. Cl.

| | |
|---|---|
| ***B65D 71/06*** | (2006.01) |
| ***A47K 10/20*** | (2006.01) |
| ***B65D 65/02*** | (2006.01) |
| *B65D 63/10* | (2006.01) |

(52) U.S. Cl.
CPC ..... *B65D 63/10* (2013.01); *B65D 65/02* (2013.01); *B65D 71/06* (2013.01)

(58) Field of Classification Search
USPC ..... 206/440, 494
See application file for complete search history.

(56) References Cited

U.S. PATENT DOCUMENTS

| | | | | |
|---|---|---|---|---|
| 5,050,742 | A * | 9/1991 | Muckenfuhs | B65D 75/54 206/494 |
| 5,540,354 | A | 7/1996 | Annand | |
| 5,853,547 | A | 12/1998 | Ahrens et al. | |
| 7,527,709 | B2 | 5/2009 | Lippi Alves Fernandes et al. | |
| 7,550,061 | B2 | 6/2009 | Walkenhaus et al. | |
| 7,774,726 | B2 | 6/2010 | Scherb et al. | |
| 8,763,807 | B2 | 7/2014 | Booch et al. | |
| 10,111,788 | B2 * | 10/2018 | Nishimura | B65D 75/38 |
| 2008/0078685 | A1 | 4/2008 | Patterson et al. | |
| 2010/0243668 | A1 | 9/2010 | Castela et al. | |
| 2013/0269893 | A1 | 10/2013 | Nelvig et al. | |
| 2014/0116913 | A1 * | 5/2014 | Thorburn | A47K 10/424 206/494 |
| 2014/0245701 | A1 | 9/2014 | Loevenich | |
| 2015/0327732 | A1 | 11/2015 | Bengtsson et al. | |
| 2018/0370718 | A1 | 12/2018 | Wallenius et al. | |

FOREIGN PATENT DOCUMENTS

| | | | | |
|---|---|---|---|---|
| CL | 200403018 | | 11/2005 | |
| CL | 2013001805 | A1 | 12/2013 | |
| CL | 2017003113 | A1 | 6/2018 | |
| CL | 2017003114 | A1 | 6/2018 | |
| CN | 103281943 | A | 9/2013 | |
| CN | 204776666 | U | 11/2015 | |
| EP | 0747295 | A1 | 12/1996 | |
| EP | 0 805 114 | A1 | 11/1997 | |
| EP | 0805114 | A1 * | 11/1997 | B65D 71/08 |
| EP | 1 156 925 | | 11/2001 | |
| EP | 2 540 637 | A1 | 1/2013 | |
| EP | 3 390 244 | | 10/2018 | |
| FR | 2939770 | B1 | 12/2010 | |
| WO | WO 2012/087211 | A1 | 6/2012 | |
| WO | WO-2012087211 | A1 * | 6/2012 | A47K 10/16 |
| WO | WO-2015146891 | A1 * | 10/2015 | B65D 75/38 |
| WO | 2017/105309 | A1 | 6/2017 | |

OTHER PUBLICATIONS

International Search Report (PCT/ISA/210) dated Sep. 2, 2016, by the Swedish Patent Office as the International Searching Authority for International Application No. PCT/SE2015/051373.
Written Opinion (PCT/ISA/237) dated Sep. 2, 2016, by the Swedish Patent Office as the International Searching Authority for International Application No. PCT/SE2015/051373.
Demand for Preliminary Examination submitted on Oct. 17, 2017, filed with the European Patent Office for International Application No. PCT/SE2015/051373.
Written Opinion (PCT/ISA/237) dated Nov. 29, 2017, by the European Patent Office as the International Preliminary Examining Authority for International Application No. PCT/SE2015/051373.
Response to the Written Opinion dated Nov. 29, 2017 submitted on Jan. 29, 2018, filed with the European Patent Office for International Application No. PCT/SE2015/051373.
Notification of Transmittal of The International Preliminary Report on Patentability and International Preliminary Report on Patentability dated Feb. 15, 2018, by the European Patent Office as the International Preliminary Examining Authority for International Application No. PCT/SE2015/051373.
Office Action (Notification of the First Office Action) dated Mar. 22, 2019, by the State Intellectual Property Office (SIPO) of the People's Republic of China in corresponding Chinese Patent Application No. 201580085427.9 and an English Translation of the Office Action. (18 pages).
Office Action dated Apr. 3, 2019, by the Canadian Intellectual Property Office in Canadian Patent Application No. 3,007,054, (4 pages).
Office Action (First Examination Report) dated Sep. 11, 2019, by the Chilean Patent Office in Chilean Patent Application No. 201801614 and an English Translation of the Office Action. (15 pages).
Extended European Search Report dated Jul. 23, 2019, issued by the European Patent Office in corresponding European Application No. 15910864.6—1016, (5 pages).
Office Action (Notification of the 2nd Office Action) dated Dec. 10, 2019 by the State Intellectual Property Office (SIPO) of the People's Republic of China in corresponding Chinese Patent Application No. 201580085427.9, and an English Translation of the Office Action. (18 pages).
Office Action (Examination Report) dated Oct. 31, 2019, by the Intellectual Property India—Government of India in corresponding Indian Patent Application No. 201817025207, with an English Translation. (6 pages).
Office Action 643 dated Mar. 10, 2020, by the Colombian Patent Office in Colombian Patent Application No. NC2018/0006012 and an English Translation of the Office Action. (16 pages).
Search Report and Written Opinion dated Jan. 21, 2020 by the Brazilian Patent and Trademark Office in corresponding Brazilian Patent Application No. BR112018009750-0, 4 pages. (English translation only).

* cited by examiner

TRANSPORT PACKAGE FOR INDIVIDUAL PACKAGES OF ABSORBENT TISSUE PAPER MATERIAL

TECHNICAL FIELD

A transport package comprising a compressible packaging and a packing configuration, the packing configuration comprising at least three individual packages of absorbent tissue paper material, and the packaging maintaining the individual packages in the packing configuration, wherein the transport package forms a rectangular parallelepiped delimited by six outer surfaces.

BACKGROUND

Absorbent tissue paper material is used for a variety of wiping and cleaning purposes. For providing absorbent tissue paper material to end users, individual stacks comprising the absorbent tissue material are conventionally used. Conventionally, the individual stacks are provided in a stack packaging so as to form an individual package. The size of such individual package may be designed such that the individual packages may be manually handled, either directly by an end user, or for example when refilling a designated dispenser with the content of the individual packages.

An example of an individual package comprising absorbent tissue paper material may be a stack formed by the absorbent tissue paper material, the stack being completely or partially surrounded by a stack packaging to maintain and/or protect the stack during transport, storage and handling thereof.

However, the size of individual packages of absorbent tissue material being suitable for manual handling thereof is not convenient when handling a large amount of such individual packages, such as when transporting or storing a large number of individual packages.

To this end, transport packages are used. A transport package would comprise a plurality of individual packages, thereby enabling the plurality of individual packages to be conveniently handled. The sizes and dimensions of such transport packages may vary.

Typically, when transporting a large number of individual packages, a plurality of transport packages will be packed onto a pallet. It is generally desired to pack material efficiently, such that an optimum number of transport packages are positioned in the volume available on one pallet.

During loading and transport of the pallets thus formed, pallets, including their content, may be stapled on top of each other. Accordingly, the content of the pallets may be subject to considerable loads.

There is a risk that absorbent tissue paper material being provided in a transport package may be adversely affected by such loads. For example, the tissue paper per se may be affected. Another problem however is that the transport package or the individual packages may be deformed and/or destroyed, such that the individual packages are not delivered to the end user in the intended condition.

Individual packages comprising absorbent tissue material paper provided in the form of stacks are conventionally arranged in a transport package in such a manner that all of the stacks inside the package are identically oriented. Conventionally, this results in the transport package being considerably more resistant to compression from loads being applied along one of its two dimensions, than from loads being applied along the other two dimensions. When positioning the resulting transport package on a pallet, such a transport package is to be oriented such that the vertical direction coincides with the dimension of the transport package providing the greatest resistance to compression. This orientation is believed to diminish the risk of individual packages becoming deformed and/or destroyed during loading or transport, in particular if an additional pallet or pallets are positioned on top of the pallet with the transport package.

In addition to the above, it is generally desired that the transport package shall be adapted to requirements during manufacturing, transport and storage thereof, which may all involve the transport packages to be packed in various configurations, and/or to be subject of different loads.

There is a general need for a transport package being suitable for transport on pallets, and preferably being well adapted to withstand the strains associated therewith. Moreover, it is preferred that the transport package may be economically manufactured using conventional packing methods. The object of the present disclosure is to provide a transport package fulfilling the need, or providing a useful alternative.

SUMMARY

The above-mentioned need is fulfilled by a transport package as mentioned in the introduction above comprising a compressible packaging and a packing configuration, the packing configuration comprising at least three individual stacks of absorbent tissue paper material, and the packaging maintaining the individual stacks in the packing configuration, wherein the transport package is forming a rectangular parallelepiped delimited by six outer surfaces, defining three transport package extensions extending along three dimensions in space defining a length (L), a width (W) and a height (H) of the transport package.

A relative deformation of the transport package is defined for each of the three dimensions, being the relative shortening of the transport package extension along a selected dimension when the entire transport package is compressed with a deformation pressure of 15 kPa between two outer surfaces and along the selected dimension.

It is proposed herein that, for the transport package, the relative deformation along at least two out of the three dimensions (length, width and height) shall be less than 10%, and that the absorbent tissue paper material of at least one of said individual stacks of said packing configuration contributes to limiting said relative deformation.

In accordance with the above, a transport package is provided displaying a relative deformation being relatively small along at least two of its three dimensions (length, width and height). Hence, along at least two of the three dimensions, the transport package resists becoming deformed or damaged if subject to considerable load.

Also, that the relative deformation is associated with at least two out of the three dimensions implies that, when being positioned on a pallet or under other circumstances where the transport package could be subject to considerable load, the transport package may advantageously be oriented with either one out of the at least two dimensions substantially parallel to vertical direction.

Advantageously, the relative deformation along all three dimensions is less than 10% at the deformation pressure of 15 kPa.

An allowable relative deformation as proposed herein may imply that the transport package is slightly deformed when subject to considerable loads, such as under the load from another pallet of transport packages, or a plurality of pallets of transport packages. However, the relative deformation may be such that the deformation occurring under such practical circumstances is non-permanent.

Accordingly, the transport package displays improved versatility when a plurality of transport packages is to be positioned on a pallet or in another restricted area or volume. This may enable improved packing of a plurality of transport packages. Also, it may enable a more free selection of dimensions when designing the transport package.

The absorbent tissue paper material of at least one of the individual stacks in the packing configuration contributes to limiting the relative deformation. This implies that the properties of the absorbent tissue material in the stacks are used to provide stability to the transport package. Accordingly, the absorbent tissue material will be efficient to carry at least some of the load to which the transport package is subject. This in turn means that relatively simple and inexpensive packing methods and materials may be used, enabling use of many types of simple, compressible packagings.

When using the absorbent tissue paper material in one or more of the individual stacks to contribute to the relative deformation, several options for how to provide the desired relative deformations are possible.

It will be understood that the stability of the individual stacks will be of importance for the load carrying properties of the tissue paper material in the individual stacks. For example, the load carrying properties of individual stacks may be different when considering loads applied towards different orientations of the individual stacks.

Also, the properties of the tissue paper material per se may influence the load carrying properties of the individual stacks.

It will be understood that tissue paper material being arranged in a relatively dense stack, i.e. so as to provide a relatively high stack density, may generally be more stable than relatively loosely packed stacks of the same tissue paper material quality. However, large compressions of tissue paper material may be detrimental to the desired functions of the tissue paper material, such as the absorption capacity, feel etc.

In addition to the properties of the absorbent tissue paper material in the individual stacks, the desired relative deformation of the transport package may also be influenced by the manner in which the individual stacks are organized in the packing configuration.

The individual stacks in the transport package could be different, i.e. they could have different outer dimensions, weight etc.

Preferably however, the individual stacks in the transport package are identical.

In many practical cases, it may easily be determined that the absorbent tissue paper material of an individual stack or stacks contributes to limiting the relative deformation of the transport package. For example, if the compressible packaging is unable to carry any load over a dimension of the packing configuration, then the tissue paper material of the individual stacks must provide the limitation against relative deformation along that dimension. This could be the case when the packaging material per se does not provide any restriction to the relative deformation, being for example a thin plastic film or a paper material. This could also be the case if the packaging material does not extend all over the dimensions, for example if the packaging material is in the form of a sleeve being more narrow than the outer dimensions of the packing configuration.

(In contrast, if providing the packing configuration in an uncompressible packaging such as e.g. a steel box surrounding it completely, it should be clear that the limitation to the relative deformation relies on the steel box only, and that the individual stacks of the transport configuration does not contribute thereto.)

In some cases, it may not be evident whether the tissue paper material of the individual stacks contributes to limiting the relative deformation of the transport package or not. In such cases, the relative deformation test method as described below may advantageously be performed on a packaging from which the packing configuration has been removed. If the packaging per se displays less relative deformation than the transport package, then the packing configuration must necessarily contribute to the relative deformation of the transport package.

The "packing configuration" is defined as the content of the packaging, comprising individual stacks of absorbent tissue paper. However, the packing configuration could optionally also include other items, such as stabilizing inserts, intermediary packaging or individual packaging for each individual stack.

The "relative deformation" may be measured in accordance with the method provided in the below.

The "dimensions" of the transport package, i.e. the length, width and height thereof may be measured in accordance with the method provided in the below.

The term "absorbent tissue paper" is herein to be understood as a soft absorbent paper having a basis weight below 65 g/m$^2$, and typically between 10 and 50 g/m$^2$. Its density is typically below 0.60 g/cm$^3$, preferably below 0.30 g/cm$^3$ and more preferably between 0.08 and 0.20 g/cm$^3$. The absorbent tissue paper may comprise one or several plies. In the case of several plies, all of the plies are to be considered when determining the basis weight and density of the absorbent tissue paper.

The packaging is a "compressible" packaging. With compressible packaging is meant herein a packaging which per se is more compressible than the complete transport package.

A compressible packaging may be a packaging which yields at a pressure (applied in accordance with the relative deformation test below, but to the packaging alone) of 15 kPa, so as to display a relative shortening of more than 10% along all three dimensions thereof. Preferably, the compressible packaging may display a relative shortening of at least 12% at 15 kPa, more preferred at least 20%. When further restrictions are made to the transport package, relating to a deformation pressure of 25 kPa, the compressible packaging may optionally be selected so as to display a relative shortening of more than 10%, preferably at least 12%, more preferred at least 20% at 25 kPa.

Accordingly, use of a compressible packaging will enable that any pressure applied to the transport package may be transferred to the absorbent material of the packing configuration.

The fibres contained in the tissue paper are mainly pulp fibres from chemical pulp, mechanical pulp, thermo mechanical pulp, chemo mechanical pulp and/or chemo thermo mechanical pulp (CTMP). The tissue paper may also contain other types of fibres enhancing e.g. strength, absorption or softness of the paper.

The absorbent tissue paper material may include recycled or virgin fibres or a combination thereof.

The absorbent tissue paper material of at least 50% of the individual stacks in the packing configuration may contribute to the relative deformation, preferably of at least 75%, preferably of all of the individual stacks in the packing configuration. The greater the proportion of individual stacks contributing to the limitation of the relative deformation, the greater use is made of the properties inherent in absorbent tissue paper material of the individual stacks. This implies that relatively simple and inexpensive packaging methods and materials may be used for the packaging, while still providing adequate, limited relative deformation.

The relative deformation along the at least two out of the three dimensions (length, width and height) may be less than 5%, preferably less than 3%.

The relative deformation of the transport package along a third dimension may be defined by the relative shortening of the transport package extension along the third dimension when the entire transport package is compressed with a deformation pressure of 15 kPa between two outer surfaces and along the selected dimension, the relative deformation being less than 15%, preferably less than 10%, most preferred less than 8%.

In accordance with the above-mentioned option, the relative deformation of the transport package along a third dimension need not necessarily be restricted to exactly the same percentage as the relative deformation along the two previously mentioned dimensions.

Still, with a sufficiently small relative deformation of the transport package along a third dimension, the resistance against compression along all three dimensions of the transport package may be improved. Accordingly, the versatility when orienting the transport package in a packing situation may also be improved.

Optionally, the relative deformation of the third dimension may be less than 15%, preferably less than 10%, most preferred less than 8%, when the entire transport package is compressed with a deformation pressure of 25 kPa.

As mentioned previously, the relative deformation of the transport package along the third dimension may optionally be the same as defined for the first two dimensions.

Optionally, the transport package may display a relative deformation of said transport package when the entire transport package is compressed with a deformation pressure of 25 kPa between two outer surfaces and along the selected dimension, wherein, for said transport package, the relative deformation along at least two out of said three dimensions (L, W, H) is less than 10%.

Optionally, the transport package may display a relative deformation being less than 10% along all three dimensions (L, W, H) when compressed with a deformation pressure of 25 kPa.

For each of the above-mentioned relative deformations along a selected dimension, a maximum elongation may be defined being the maximum relative lengthening of the transport package extensions perpendicular to the selected dimension along which the transport package is compressed at a deformation pressure of 15 kPa, the maximum elongation being less than 5%, preferably less than 3%.

Optionally, the maximum elongation may be less than 5%, preferably less than 3%, when the transport package is compressed at a deformation pressure of 25 kPa.

When determining the relative deformation for a selected dimension, the transport package is compressed between two of its outer surfaces and along the selected dimension. During the compression, the transport package may bulge outwardly along the other two dimensions, resulting in an elongation in the directions perpendicular to compression direction.

Preferably, the elongation is relatively small. Such a relatively small elongation means that the transport package will be relatively unaffected by loading along the selected direction, which facilitates dense packing of the transport packages.

The packaging may be such that, when said transport package is compressed along a selected dimension with a deformation pressure of 15 kPa, the packaging is maintained in an intact condition. The packaging being maintained in an intact condition means that the packaging is not permanently deformed or destroyed by the pressure applied. Advantageously, the transport package is such that when the transport package is compressed with a deformation pressure of even 25 kPa, the packaging is still maintained in an intact condition.

Hence, not only the individual stacks inside the transport package are protected from becoming deformed or destroyed during transport and/or loading, but also the packaging of the transport package. Accordingly, the appearance and function of the transport package after transport and/or loading will be substantially the same as before the transport and/or loading.

The packaging may completely enclose the packing configuration.

For example the packaging may be in the form of a closed bag of i.e. plastic film or paper In another example, the packaging may be in the form of a box, for example a cardboard box.

The packing substantially completely enclosing the packing configuration is advantageous in that the packing configuration will be isolated and protected from the surrounding environment.

Alternatively, the packaging may partially enclose the packing configuration. For example, the packing may extend over only four out of the six outer surfaces of the transport package, thereby forming a sleeve surrounding the packing configuration. Such a sleeve may e.g. be formed by a plastic wrapper encircling the packing configuration.

In order to provide sufficient stability to the transport package, it is believed that such a tube shaped packing should extend over at least 30%, preferably at least 50% of the extension of the packing configuration along the tube.

Advantageously, the packaging may comprise disposable material. The packaging is hence intended for one-time-use only, and may optionally be destroyed upon opening of the packaging.

As stated above, the packaging is to be a compressible packaging. Moreover, the packaging may be a collapsible packaging.

With a "collapsible packaging" is meant herein a packaging which cannot in itself form an outer container displaying all three dimensions length, width and height of the transport package.

In other words, if the content, i.e. the packing configuration, is removed from the transport package, the remaining packaging will per se not form a freestanding parallelepiped with the length, width and height of the transport package.

Accordingly, along at least one out of said three dimensions (height, length and width), the collapsible packaging cannot provide any substantial resistance to compression of the transport package, i.e. it does not contribute substantially to limiting the relative deformation along said at least one direction.

The collapsible packaging may be a packaging which is collapsible along at least one direction, or preferably, it may be a packaging which is collapsible along at least two, preferably all of said directions (length, width and height) of the transport package.

A packaging which is collapsible along all of the length, width and height directions of the transport package will, if the content (the packing configuration) is removed, display no or very little resistance against deformation if compressed along any such directions. In other words, at 15 kPa compression pressure, the relative deformation would approach 100%.

Generally, a collapsible packaging will be unable to form the extensions of the length, width, and/or height of the transport package when the content is removed therefrom.

Instead, the collapsible packaging will typically collapse along at least one of said dimensions when the packing configuration is not there to provide the necessary stiffness to the structure.

An example of a collapsible packaging being collapsible along all three dimensions is a plastic or paper bag.

Suitable materials for forming a collapsible packaging may be a paper, non-woven or plastic material. For example, the packaging may be based on a PE or PP film, a starch-based film, PLA, or a paper material, e.g. a coated or a non-coated paper.

Another example of a collapsible packaging may be a single wrapping material formed by a PP film. Such a wrapping material may be swept around the packing configuration so as to encircle the packing configuration along at least one, preferably two planes.

It will be understood that a packaging not spanning the full height, length, or width of the transport package will necessarily be collapsible along the relevant dimension.

Possibly, a collapsible packaging may comprise some portions made out of a material displaying some rigidity if compressed. Such portions could for example be arranged such that they are nevertheless unable to substantially limit the relative deformation along at least one dimension of the transport package.

However, a collapsible packaging may advantageously be made out of a flexible material. With "flexible" is meant herein a material which is drapable without substantial folding or creasing. For example, a plastic film with a basis weight below 100 g/m$^2$, advantageously 40 to 100 g/m$^2$, or a paper with a basis weight below 200 g/m$^2$, preferably 80-200 g/m$^2$, are considered to be flexible materials.

Accordingly, a bag made out of a plastic film or a paper as set out in the previous paragraph would be an example of a collapsible, flexible packaging suitable for the transport package.

Optionally, the packaging may be a non-collapsible packaging such as a box. A "non-collapsible packaging" is considered herein to be a packaging which, when the content (the packing configuration) is removed from transport package, is still able to span the three dimensions length, width and height of the transport package, and which provides at least some resistance to compression if the packaging is compressed along said three directions.

An example of a non-collapsible packaging may be a box made out of a suitable material, such as a cardboard box.

However, by provision of the packing configuration as described herein, it is intended that the packing configuration, and in particular the absorbent material of the stacks therein, per se will contribute to limiting the relative deformation of the transport package.

Accordingly, in accordance with the present disclosure, even a non-collapsible packaging should be compressible as set out in the above.

Accordingly, only relatively compressible non-collapsible packagings may be considered, such as i.e. a cardboard box made out of a relatively weak cardboard material.

When the packaging is non-collapsible, the relative deformation of the transport package, when compressed with a deformation pressure of 25 kPa between two outer surfaces and along the selected dimension, may advantageously be less than 10% along at least two out of said three dimensions (L, W, H).

The packing configuration may form a rectangular parallelepiped delimited by six outer surfaces, generally corresponding to the rectangular parallelepiped formed by the transport package. Accordingly, the outer shape of the transport package is primarily determined by the outer shape of the packing configuration.

Preferably, the packing configuration defines a length, a width and a height, generally corresponding to the length, width and height of the transport package. The addition of the packaging to the length, width and height of the transport package may be relatively small, i.e. less than 1% of the respective extensions.

The packaging may be arranged to tightly fit around the packing configuration. Generally, it may be desired that the packaging is arranged so as to fit, or to slightly compress the packing configuration. The limited relative deformation of the transport package may be obtained by the packaging maintaining the packing configuration in such a state that the individual stacks of the packing configuration are effective to resist the relevant loads. To this end, the individual stacks may be arranged such that a load distribution takes place between individual stacks in the packing configuration.

The packing will form an outer boundary, restricting the movement and/or distortion of the individual stacks and hence enabling the force distribution.

The packaging may be regarded to define a packaging length, packaging width and packaging height.

The largest out of the packaging length and the packing configuration length, the packaging width and the packing configuration width, the packing height and the packaging height, will naturally form the length, width, and height, respectively of the transport package.

It will be understood, that when discussing the dimensions of the packaging and the packing configuration, it is referred to the dimensions of these items when forming the complete transport package.

The packing configuration comprises at least three individual stacks of absorbent tissue paper material.

Advantageously, the packing configuration comprises at least 10 individual stacks of absorbent tissue paper material, preferably at least 15 individual stacks of absorbent tissue paper material. Suitably, the packing configuration may comprise no more than 50 individual stacks of absorbent tissue paper material.

Advantageously, each stack is provided in an individual package comprising the stack of absorbent tissue paper material and a stack packaging.

The stack packaging may advantageously be formed e.g. as a closed package or in the form of a wrapper encircling the stack.

To promote a uniform appearance of the stacks, it is preferred that the stack packaging, when applied to the stack, extends over the full length L and width W of the stack, i.e. over the complete end surfaces of the stack.

However, the stack packaging may also be in the form of e.g. a wrap-around strip.

The stack packaging may for example made of a paper, non-woven or plastic material. The packaging material may be selected so as to be being recyclable with the absorbent tissue paper material of the package. For example, the packaging may be based on a PE or PP film, a starch-based film, PLA, or a paper material, e.g. a coated or a non-coated paper.

Advantageously, the stack packaging may be compressible, similar to the packaging of the transport package. Accordingly, it may be ascertained that the stacks contribute to the relative deformation of the transport package, rather than the stack packaging.

The stack packaging may advantageously be collapsible and/or of a flexible material.

Suitable flexible materials for a stack packaging may be similar to the flexible materials described in the above relating to the transport package packaging.

Such a flexible material may advantageously form a stack packaging e.g. in the form of a a wrapper or a wrap-around strip.

The transport package may optionally comprise items in addition to the individual stacks of absorbent tissue paper material, such as items for facilitating the packing of the individual stacks, or intermediary packaging. However, it is still required that the absorbent tissue paper material of at least one, preferably all, of the individual stacks contributes to limiting the relative deformation.

However, the packing configuration may advantageously consist of the individual stacks of absorbent tissue paper material, comprising only any individual stack packaging. In this case a minimum amount of packing material may be required. Also, particularly efficient processes for manufacturing the transport package are enabled.

In each individual stack, the absorbent tissue paper material may form panels having a stack length (SL) and a stack width (SW), perpendicular to the stack length (SL), the panels being piled on top of each other to form a stack height (SH).

For example, the stack length may be between 50 and 300 mm, where 50 to 200 mm is particularly suitable for napkins, and about 150 to 300 mm is particularly suitable for towels.

The stack width may be between 50 and 200 mm, where 50 to 200 mm is particularly suitable for napkins, whereas 50 to 150 mm is particularly suitable for towels.

The stack height may be between 50 and 250 mm, this range being equally suitable for napkins and for towels.

A stack of absorbent tissue material will per se display a relative deformation when subject to loading. In particular, the relative deformation may vary depending on the orientation of the stack, i.e. depending on which dimension of the stack is considered. Accordingly, when forming the packing configuration, the orientation of the individual stacks may be used to form a packing configuration enabling a transport package with the desired relative deformation properties.

Optionally, in the packing configuration of the transport package, at least two individual stacks in the transport package are arranged with their respective stack lengths (SL) extending in parallel to different transport package extensions (W, L, H).

Optionally, in the packing configuration of the transport package, at least 50% of the individual stacks are arranged with their respective stack lengths (SL) extending in parallel to the same transport package extension (L), preferably all of the individual stacks are arranged with their respective stack lengths (SL) extending in parallel to the same transport package extension (L).

Optionally, in the packing configuration, less than 50% of the individual stacks are arranged with their respective stack lengths (SL) extending in parallel to one of the extensions (W, H) displaying the relative deformation.

Optionally, in the packing configuration, less than 50% of the individual stacks are arranged with their respective stack lengths (SL) extending in parallel to the third extension, preferably none of the individual stacks is arranged with its stack length (SL) extending in parallel to the third extension.

Optionally, in the packing configuration, at least 50% of the individual stacks are arranged with their respective stack heights (SH) extending in parallel to the third extension, preferably all of the individual packages are arranged with their stack heights (SH) extending in parallel to the third extension.

The absorbent tissue paper material may comprise a dry crepe material, a structured tissue material, a wet crepe material, or a combination material comprising at least two of the afore-mentioned materials.

The absorbent tissue material is a dry material, in contrast to intentionally wet materials such as wet wipes.

For example, the absorbent tissue paper material may comprise dry crepe material only or it may be a combination of at least a dry crepe material and at least a structured tissue material.

A structured tissue material is a three-dimensionally structured tissue paper web.

The structured tissue material may be a TAD (Through-Air-Dried) material, a UCTAD (Uncreped-Through-Air-Dried) material, an ATMOS (Advanced-Tissue-Molding-System), an NTT (New Tissue Technology) material, or a combination of any of these materials.

A combination material is a tissue paper material comprising at least two plies, where one ply is of a first material, and the second ply is of a second material, different from the first material.

Optionally, the tissue paper material may be a combination material comprising at least one ply of a structured tissue paper material and at least one ply of a dry crepe material. Preferably, the ply of a structured tissue paper material may be a ply of TAD material or an ATMOS material. In particular, the combination may consist of structured tissue material and dry crepe material, preferably consist of one ply of a structured tissue paper material and one ply of a dry crepe material, for example the combination may consist of one ply of TAD or ATMOS material and one ply of dry crepe material.

An example of TAD is known from U.S. Pat. Nos. 5,5853,547, ATMOS from U.S. Pat. No. 7,744,726, 7,550,061 and 7,527,709; and UCTAD from EP 1 156 925.

Optionally, a combination material may include other materials than those mentioned in the above, such as for example a nonwoven material.

Alternatively, the tissue paper material is free from nonwoven material.

The stacks may have a stack density of at least 0.20 $kg/dm^3$, preferably between 0.20 and 0.80 $kg/dm^3$.

It has been found that stacks displaying a relatively large stack density, are relatively resistant against compressions in all three dimensions. Accordingly, with stacks displaying a relatively large stack density, numerous configurations for forming packing configurations suitable for forming a transport package displaying the desired properties are enabled.

The absorbent tissue paper material may be a dry crepe material, and the selected stack density between 0.30 and 0.95 $kg/dm^3$.

Optionally, the absorbent tissue paper material is a dry crepe material, and preferably the selected stack density is between 0.30 and 0.65 $kg/dm^3$, most preferred between 0.35 and 0.65 $kg/dm^3$.

The absorbent tissue paper material may be a structured tissue material, and the selected stack density between 0.20 and 0.75 kg/dm$^3$.

Optionally, the absorbent tissue paper material is a structured tissue material, and preferably the selected stack density is between 0.20 and 0.50 kg/dm$^3$, most preferred between 0.23 and 0.50 kg/dm$^3$.

The absorbent tissue paper material may be a combination material, comprising at least a dry crepe material and at least a structured tissue material, and the selected stack density being between 0.25 and 0.80 kg/dm$^3$.

Optionally, the absorbent tissue paper material is a combination material, comprising at least a dry crepe material and at least a structured tissue material, and preferably the selected stack density is between 0.25 and 0.55 kg/dm$^3$, most preferred between 0.30 and 0.55 kg/dm$^3$.

The absorbent tissue paper material may be a material intended generally for cleaning or wiping purposes, such as for example napkins, facial tissues, folded toilet paper, hand wipes or object wipes.

The stack density is the density of the stack as maintained in any stack packaging. The stack density may be defined as the weight of the stack divided with the volume of the stack, the volume being the length SL of the panels×the width SW of the panels×the height SH of the stack when inside the stack packaging. More specific definitions are found in the method description in the below.

The transport package may have a packing density as defined in the below of at least 0.20 kg/dm$^3$, preferably between 0.20 kg/dm$^3$ and 0.80 kg/dm$^3$.

The packing density of the transport package may be determined by measuring the height, width and length of the transport package and the weight of the packing configuration.

In a second aspect, the object is achieved by a method for forming a transport package as described in the above, the transport package comprising at least three individual stacks of absorbent tissue paper material, the method comprising selecting a compressible packaging, arranging the individual stacks in a packing configuration, and arranging the compressible packaging so as to maintain the packing configuration to form the transport package.

BRIEF DESCRIPTION OF THE DRAWINGS

In the following, the transport package will be described with reference to exemplary embodiments, being non-limiting examples only, as illustrated in the accompanying drawings wherein.

DETAILED DESCRIPTION OF PREFERRED EMBODIMENTS

Figure 1:
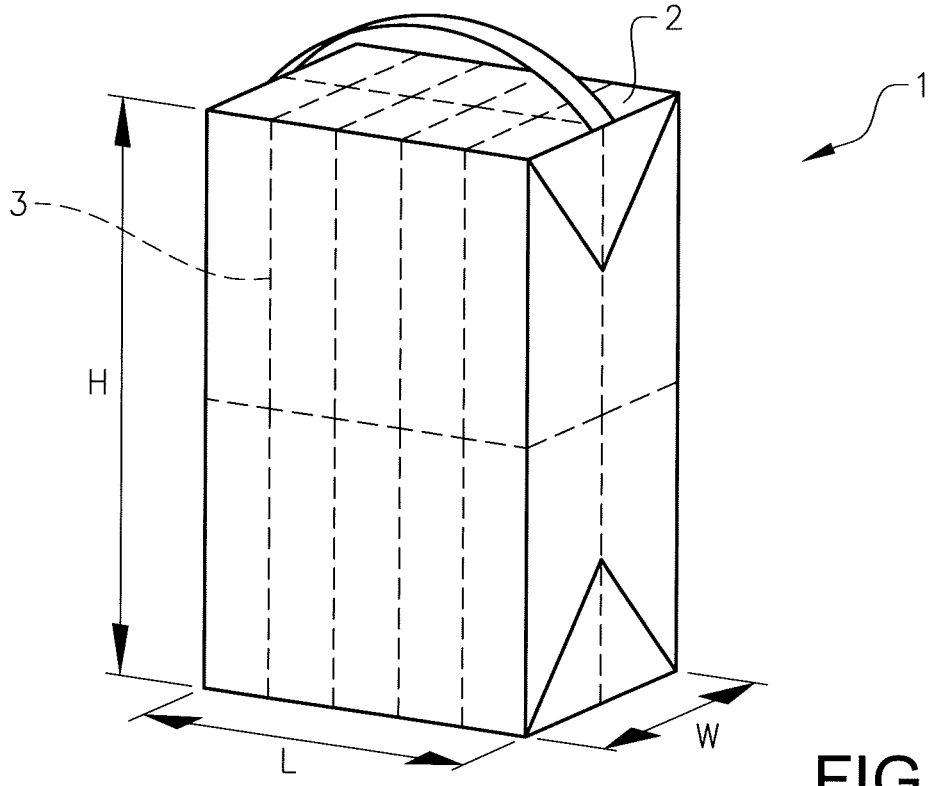
FIG. 1 illustrates an example of a transport package in accordance with an embodiment.

FIG. 1 illustrates a transport package 1 comprising a packaging 2 and a packing configuration 3. The transport package 1 forms a rectangular parallelepiped delimited by six outer surfaces, defining three transport package extensions extending along three dimensions in space defining a length L, a width W and a height H of the transport package 1.

The packing configuration 3 constitutes the content of the packaging 2, and may comprise at least three individual stacks 4 of absorbent tissue paper material.

Figure 2:
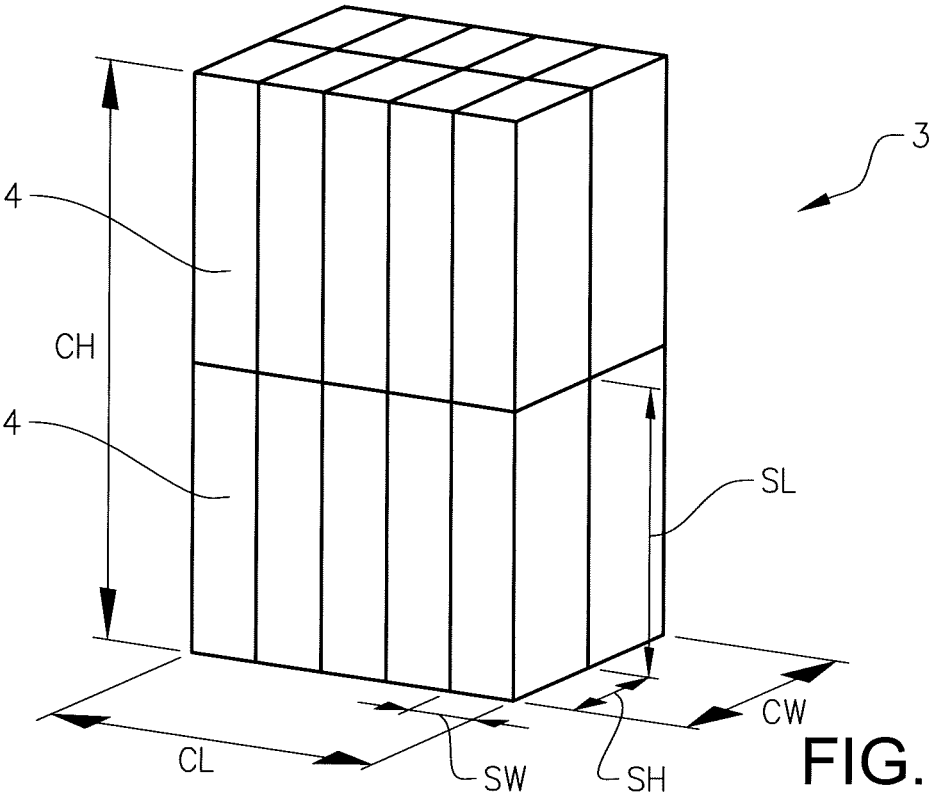
FIG. 2 illustrates a packing configuration of the transport package of FIG. 1.

In FIG. 2, the packing configuration 3 of the transport package 1 is displayed without the packaging 2. It will be understood, that as it is the packaging 2 which maintains the individual stacks 4 in the packing configuration 3, the packing configuration 3 may not be achievable as a free-standing unit. For, example, it may be that the restriction provided by the packaging 2 is necessary to e.g. force the individual stacks 4 as close together as they will be in the packing configuration 3 inside the transport package 1. Accordingly, FIG. 2 is theoretical in the sense that it displays the packing configuration 3 as it appears when inside the transport package 1.

Advantageously, the packing configuration 3 comprises at least 10 individual stacks 4. A suitable number of stacks 4 may be between 10 and 50.

In the illustrated embodiment, the packing configuration 3 comprises 20 stacks 4. As understood by the term "packing configuration", the stacks 4 shall be arranged in an orderly manner so as to form a configuration.

To this end, the stacks may for example be arranged in rows and/or columns and/or layers. The exemplary embodiment of FIGS. 1 and 2 illustrate a packing configuration 3 where the stacks are arranged in a L×W×H configuration including 5×2×2 stacks. Hence, the arrangement may be described as two layers L×W of 5×2 stacks, arranged along the height direction.

Optionally, the transport package may comprise a single layer, although a preferred option is that the transport package comprises a plurality of layers. The layers in a plurality of layers may be identical (as illustrated in FIG. 2) or they may be different.

Advantageously, the transport package may comprise two to six layers, preferably two to four layers.

A relative deformation of the transport package 1 may defined for each of the three dimensions L, W, H, being the relative shortening of the transport package extension along a selected dimension when the entire transport package is compressed with a deformation pressure of 15 kPa between two outer surfaces and along the selected dimension.

The relative deformation along at least two out of the three dimensions (L, W, H) is less than 10%, and at least some of the individual stacks 4 of the packing configuration 3 contribute to limiting the relative deformation.

In the illustrated embodiment, the relative deformation along the two dimensions being the height H and the length L of the transport package 1 fulfils the above-mentioned conditions for sufficient relative deformation.

Accordingly, when the transport package 1 is to be transported or stored, and in particular when it is to be loaded onto a pallet, the transport package 1 may be oriented as illustrated in FIG. 1, i.e. with the height dimension H extending in a vertical direction, since the relative deformation along this dimension is limited such that the transport package may resist such loads as may appear e.g. when a second pallet of products is positioned on top of the first. However, the transport package 1 may also be oriented with the length dimension L extending in a vertical direction, since the relative deformation along this dimension is also limited to resist relevant loads.

Accordingly, the transport package 1 displays two different orientations which are both suitable for transport and storage of the transport package. Accordingly, the versatility when handling or packing a number of transport packages within limited volume is increased.

Advantageously, also the relative deformation of the transport package 1 along a third dimension (in this example being the width W), being defined by the relative shortening of the transport package extension along the third dimension when the entire transport package is compressed with a pressure of 15 kPa between two outer surfaces and along the dimension selected dimension, is less than 15%, preferably less than 10%, most preferred less than 8%.

Accordingly, the transport package 1 displays three different orientations which are all suitable for transport and storage of the transport package, resulting in an increased versatility.

To enable use of simple and cost efficient materials for the packaging 2, it is intended that the absorbent tissue material of at least some of the stacks 4 of the packing configuration contributes to limiting the relative deformation.

In the illustrated embodiment, the packaging 2 comprises a flexible plastic material, in the form of a closed plastic bag of polymeric material. Such a plastic bag is an example of a collapsible packaging 2, being a packaging which is unable to span over a volume by itself. Instead, when using a collapsible packaging 2, the packing configuration 3 provides the stability of the transport package 1.

The desired relative deformation is preferably to be achieved while maintaining the packaging 2 in an intact condition. With the packaging 2 forming a plastic bag as in the illustrated embodiment of FIG. 1, this may easily be achieved.

Advantageously, the packaging 2 comprises disposable material, such as the afore-mentioned plastic bag. Other disposable materials may be various forms of paper or suitable cardboard materials.

As seen in FIG. 2, also the packing configuration 3 forms a rectangular parallelepiped delimited by six outer surfaces, defining a length CL, a width CW and a height CH of the packing configuration 3.

The parallelepiped formed by the packing configuration 3 generally corresponds to the rectangular parallelepiped formed by the transport package 1, i.e. the length CL, width CW and height CH of the packing configuration 3 generally corresponding to the length L, width W and height H of the transport package 1.

Accordingly, there is essentially no empty space formed inside the packaging 2 which, in a situation when the transport package 1 is subject to load, is not used for taking up the packing configuration 3. Moreover, the tight fit resulting by the packing configuration 3 generally corresponding to the shape of the packaging 2 enables efficient transfer of the load applied on the packaging 2 to the packing configuration 3, resulting in the load becoming distributed to the individual stacks 4.

When using a collapsible packaging 2, e.g. made by a flexible material, the packaging 2 yields at the pressures applied when determining the relative deformation of the transport package 1.

Preferably, the limitation to the relative deformation is essentially completely provided by the packing configuration, as exemplified by the illustrated embodiment. In this case, the role of the packaging is rather to maintain and support the packing configuration during loading, than to resist loading by itself.

Generally, it is preferred that all of the individual stacks 4 in the packing configuration contribute to limiting the relative deformation of the transport package 1.

When measuring a relative deformation along a selected dimension (for example along the height H), a maximum elongation may be defined being the maximum relative lengthening of the transport package extensions perpendicular to the selected dimension (in the example being the width W and the length L). The relative lengthening is the measured lengthening along an extension divided with the relevant original extension, as determined in accordance with the method below.

Advantageously, the maximum elongation may be less than 5%, preferably less than 3%.

Figure 3:
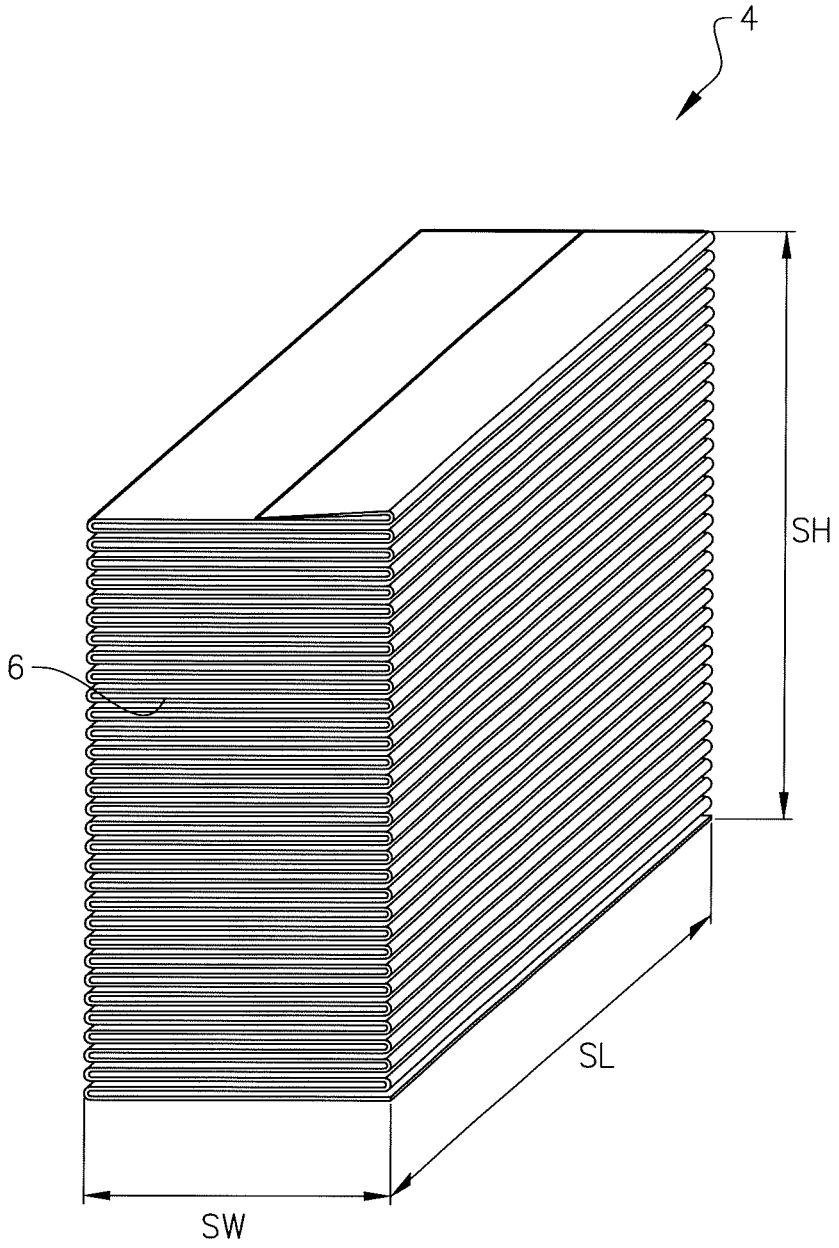
FIG. 3 illustrates an example of an individual stack which may be packed in a transport package.

FIG. 3 illustrates an example of an individual stack 4 of absorbent tissue paper material.

In the individual stack 4, the absorbent tissue paper material 6 forms panels having a stack length SL and a stack width SW, perpendicular to the stack length SL, the panels being piled on top of each other to form a stack height SH. In the embodiment illustrated in FIG. 3, the stack comprises a folded web of absorbent tissue paper material 6. However, the stack 4 may also comprise sheets of absorbent tissue paper material 6. Such sheets may be folded, in which case they may be separately folded, or interfolded with each other. Alternatively, the sheets may be sized so as to correspond to the size of the above-mentioned panels of the stack 4, in which case no folding is necessary.

It will be understood that the dimensions of a stack 4 may vary, and likewise, the dimensions of a transport package 1 may vary. For example, a suitable size for a transport package may be 40×60×20 cm. Generally, a transport package may advantageously have dimensions greater than about 40×30×20 cm. The total weight of transport package may be between 4 and 15 kg. It may be preferred that the total weight of a transport package is less than or equal to 10 kg.

Figure 4A:
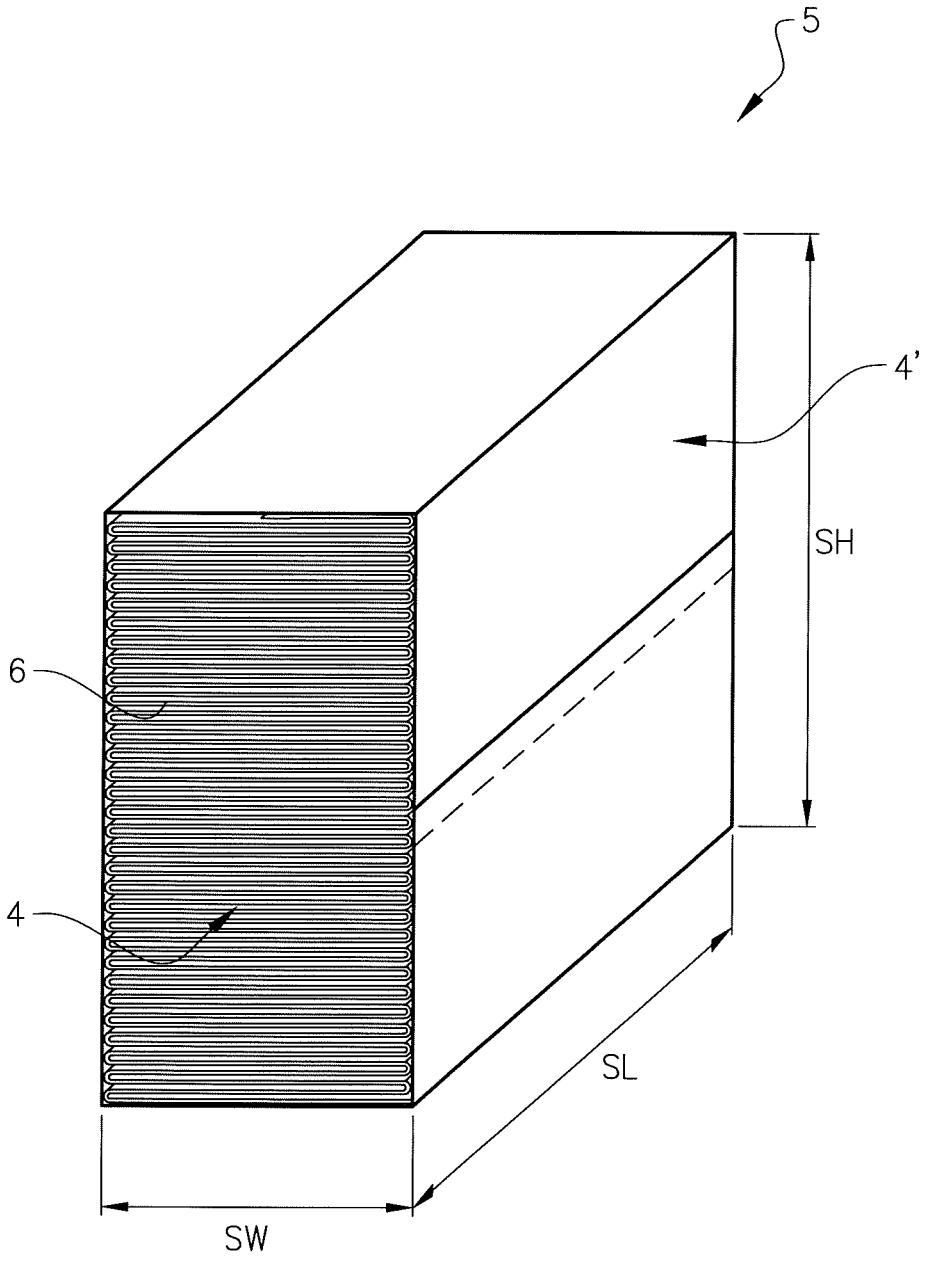
FIGS. 4*a* and 4*b* illustrate examples of an individual package comprising the stack of FIG. 3.
Figure 4B:
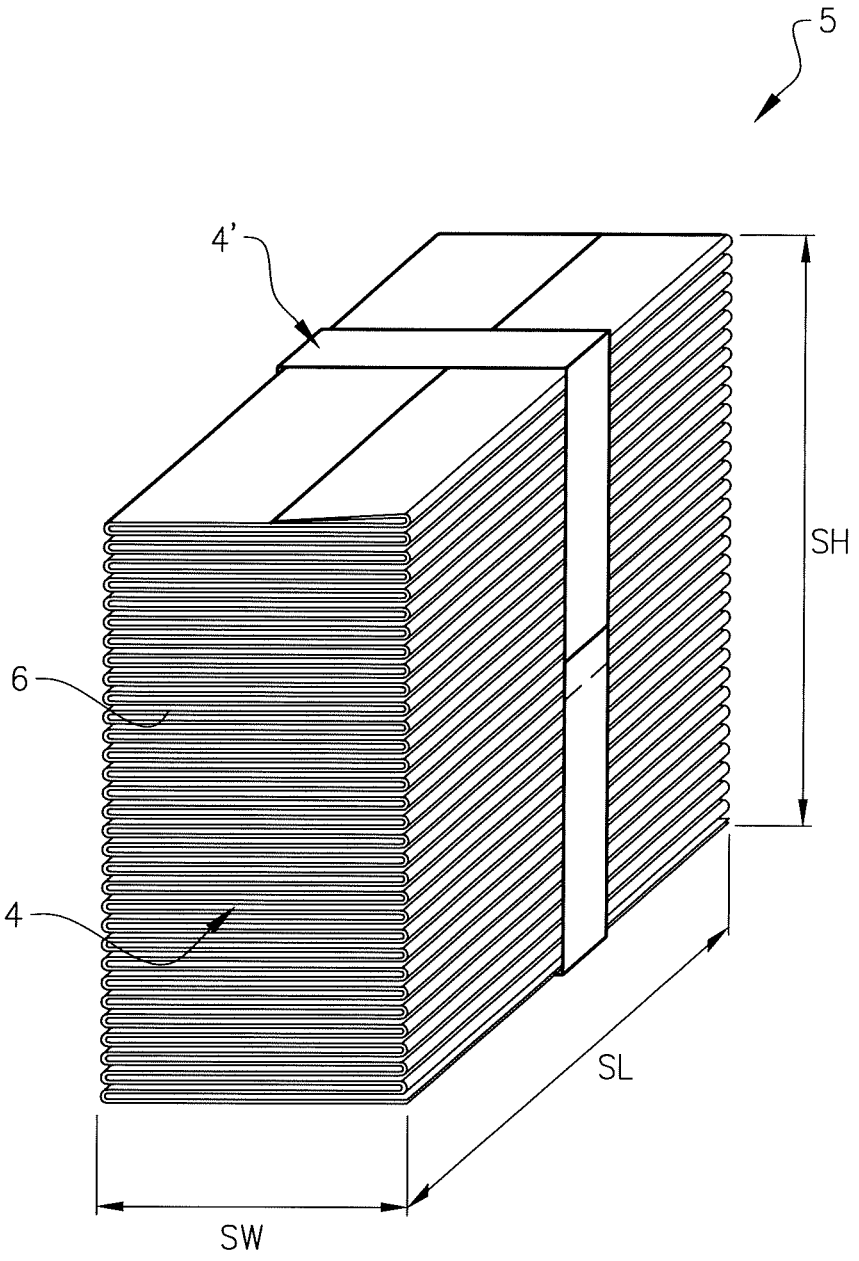

Advantageously, and as illustrated in FIGS. 4*a* and 4*b*, the individual stacks 4 of absorbent tissue paper material 6 may be provided in an individual package 5 comprising the stack 4 and a stack packaging 4'.

The intention of the present disclosure being to utilize the properties of the absorbent tissue paper material in the stacks 4 for providing the required limited relative deformation, it will be understood that it is generally desired to use stack packaging 4' which do not hinder the distribution of loads to the stacks 4.

Accordingly, the stack packaging 4' may advantageously be compressible, such that it yields at relevant loads as described herein. Typically, the stack packaging 4' would be collapsible.

Many conventional stack packagings 4' are suitable for the above-mentioned purpose, and comprise flexible materials. Such a flexible material may be arranged to form a complete enclosure around the stack 4. However, it may be preferred to have the stack packaging 4' only to partially enclose the stack 4, e.g. by forming a wrapper or a wrap-around strip.

In the illustrated embodiments of FIGS. 4*a* and 4*b*, the stack packaging comprises a paper material of e.g. 50-90 gsm.

In the embodiment of FIG. 4*a*, the stack packaging 4' is in the form of a sleeve extending over the full length SL and height SH of the stack, but leaving the end portions of the stack 4 uncovered.

In the embodiment of FIG. 4*b*, the stack packaging 4' is in the form of a strip extending centrally over the length dimension SL, and surrounding the stack 4 in a plane parallel to a plane including the stack height SH and stack width SW.

Advantageously, and as illustrated in FIGS. 1 and 2, the packing configuration 3 consists of the individual packages 5 of stacks 4 of absorbent tissue paper material. Accordingly, the transport package 1 consists of the individual packages 5 and the packaging 2, with no additional material being required.

As mentioned in the above, in the packing configuration 3 the stacks 4 may form rows and/or columns and/or layers.

Advantageously, the packing configuration 3 may be formed with substantially no space between stacks 4.

In the embodiment illustrated in FIGS. 1 and 2, the individual stacks 4 are arranged in parallel to each other. All stacks 4 are arranged with the stack length SL extending in parallel to the same transport package extension, namely the height H of the illustrated embodiment. Also, all of the stacks are arranged with the stack height H extending in parallel to the same transport package extension, namely the width W of the illustrated embodiment.

It may be noted, that in the illustrated embodiment of FIGS. 1 and 2, the limited relative deformation may be achieved along both the height direction H and the width direction W of the transport package 1.

Also, none of the individual stacks 4 is arranged with the stack length SL extending in parallel to the length direction L of the transport package 1. Instead, all of the individual stacks 4 are arranged with their respective stack heights SH extending in parallel to the width direction W of the transport package 1. Still, as mentioned in the above, a sufficient relative deformation may be achieved along the width direction W of the transport package 1.

It will be realized that numerous embodiments of transport packages 1 are conceivable. Various packing configurations 3 may be assumed and tested to ensure whether they fulfil the relative deformation requirements as set out in the above.

Figure 5:
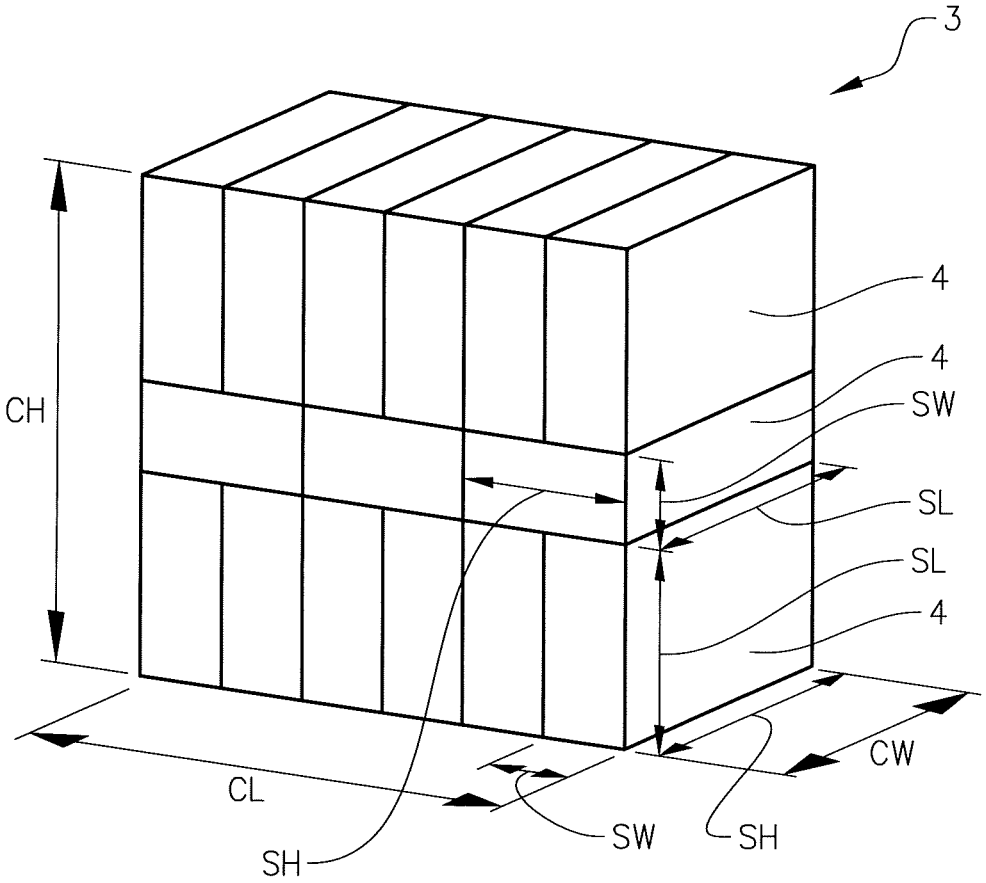
FIG. 5 illustrates an example of a packing configuration for forming a transport package.

FIG. 5 illustrates a first variant of a packing configuration 3, comprising three different layers as seen along a height direction H of the transport package 1 (or CH of the packing configuration 3). Two layers are identical, each comprising a row of individual stacks 4 arranged such that the stack lengths SL coincide with the height H of the transport package 1. A third layer is positioned in between the two identical layers. In the third layer, the stacks 4 are instead arranged with the stack lengths SL extending in parallel to the width W of the transport package 1. In the illustrated example, the stack length SL is seen to be equal to the stack height SH.

It will be understood that numerous alternatives may be formed where the respective stack lengths SL of the stacks extend in parallel to different transport package extensions W, L, H.

Advantageously, the stacks may be selected so as to have a stack density of at least 0.20 kg/dm3, preferably between 0.20 kg kg/dm$^3$ and 0.80 kg/dm$^3$.

The transport package 3 may have a packing density of at least 0.20 kg/dm$^3$, preferably between 0.20 kg/dm$^3$ and 0.80 kg/dm$^3$.

Accordingly, it will be understood that a transport package packing density including the packing configuration 3 may advantageously be approximately equal to the density of the stacks 4.

As mentioned in the above, the absorbent tissue paper material may comprise a dry crepe material, a structured tissue material, a wet crepe material, or a combination material comprising at two of the afore-mentioned materials.

EXAMPLES

FIGS. 7*a*-7*h* illustrate the results of relative deformation measurements, performed in accordance with the method as described in the below, on three different transport packages. TP1 and TP2 are transport packages available on the market today, whereas TP3 is a transport package in accordance with the present disclosure.

TP1. Folded Towels System H2, SCA Art nr 100288.

Absorbent Tissue Paper Material:

Combination material (also called a hybrid material) comprising one ply structured tissue, virgin fibre 20.5 gsm and one ply Dry Crepe, virgin fibre 23.5 gsm. The combination material has a basis weight of totally 44 gsm.

Stack:

Every stack consists of 110 individual products in the form of folded towels. The folds are arranged so as to extend along the stack length SL.

Stack Height (SH): 130 mm
Stack Length (SL): 212 mm
Stack Width (SW): 85 mm width,
Stack density: 0.15 kg/dm$^3$.

Figure 7A:
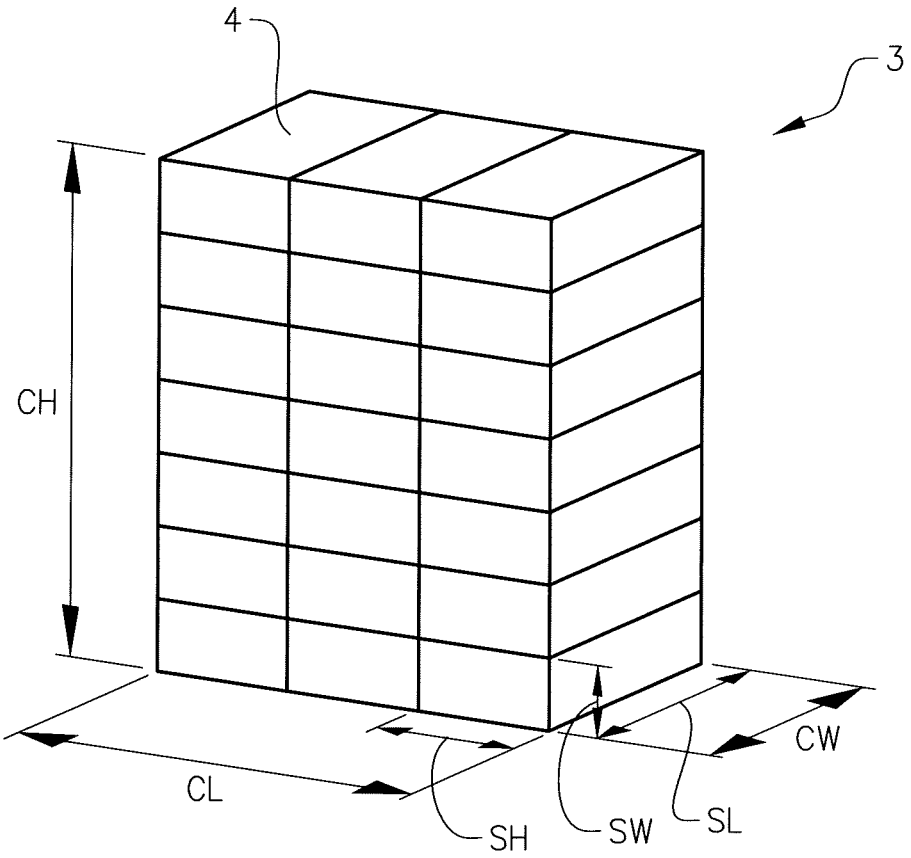
FIGS. 7*a*-7*h* illustrate the results achieved in relative deformation measurements for different transport packages.

Packing Configuration:

The packing configuration comprises 21 stacks, arranged in three rows and forming 7 layers, as described and illustrated in relation to FIG. 7*a*.

Packing configuration dimensions:
Height (CH): 590 mm
Length (CL): 390 mm
Width (CW): 212 mm Packaging The packing configuration was enclosed in a carry-bag type packaging, in the form of a plastic bag with a handle. The bag was sized and shaped so as to correspond to the dimensions of the packing configuration as set out in the above. The packing material was a PE mono film having a film thickness of 60 microm.

Transport Package:

Transport package dimensions:
Height (H): 590 mm
Length (L): 390 mm
Width (W): 212 mm
Transport package packing density: 0.15 kg/dm$^3$.

TP2. Folded Towels System H2, SCA Art nr 120288.

Absorbent Tissue Paper Material:

Combination material (also called a hybrid material) comprising one ply structured tissue, virgin fibre 18.5 gsm and one ply Dry Crepe, virgin fibre 18.5 gsm. The combination material has a basis weight of totally 37 gsm.

Stack:

Every stack consists of 136 individual products in the form of folded towels. The folds are arranged so as to extend along the stack length SL.

Stack Height (SH): 130 mm
Stack Length (SL): 212 mm
Stack Width (SW): 85 mm width,
Stack density: 0.15 kg/dm$^3$.

Packing Configuration:

The packing configuration comprises 21 stacks, arranged in three rows and forming 7 layers, as described and illustrated in relation to FIG. 7*a*.

Packing configuration dimensions:
Height (CH): 590 mm
Length (CL): 390 mm
Width (CW): 212 mm Packaging:

The packing configuration was enclosed in a carry-bag type packaging, in the form of a plastic bag with a handle. The bag was sized and shaped so as to correspond to the dimensions of the packing configuration as set out in the above. The packing material was a PE mono film having a film thickness of 60 microm.

Transport Package:

Transport package dimensions:

Height (H): 590 mm

Length (L): 390 mm

Width (W): 212 mm

Transport package packing density: 0.15 kg/dm$^3$.

TP3. Folded Towels System H2, Products Similar to Those of 100288

Absorbent Tissue Paper Material:

Combination material (also called a hybrid material) comprising one ply structured tissue, virgin fibre 20.5 gsm and one ply Dry Crepe, virgin fibre 23.5 gsm. The combination material has a basis weight of totally 44 gsm.

Stack:

Every stack consists of 119 individual products in the form of folded towels. The folds are arranged so as to extend along the stack length SL.

Stack Height (SH): 70 mm

Stack Length (SL): 212 mm

Stack Width (SW): 87 mm width,

Stack density: 0.30 kg/dm$^3$.

Figure 7B:
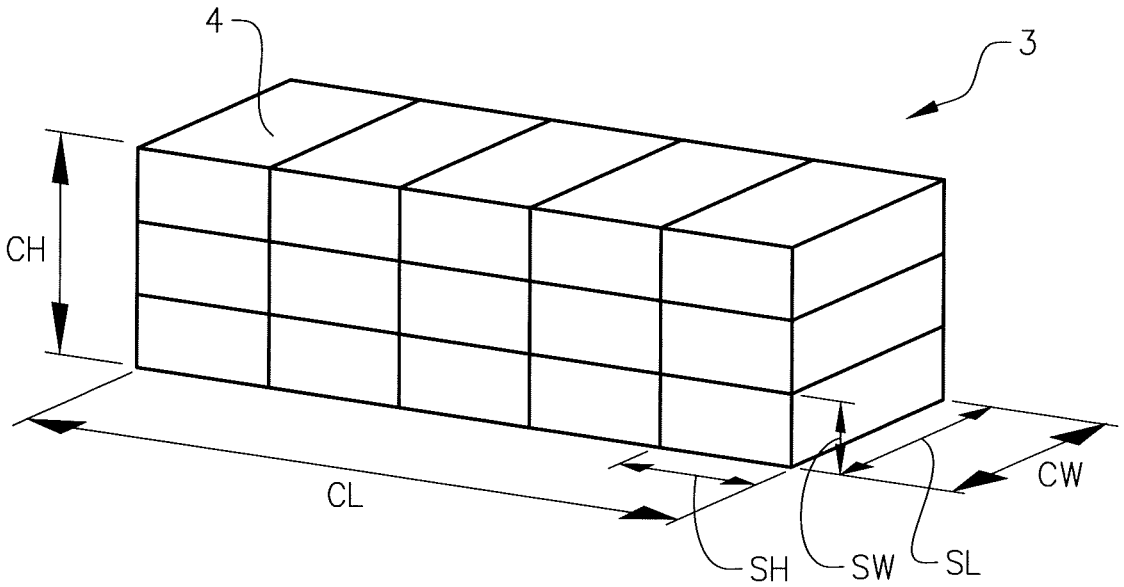

Packing Configuration:

The packing configuration comprises 15 stacks, arranged in five rows and forming three layers, as described and illustrated in relation to FIG. 7*b*.

Packing configuration dimensions:

Height (CH): 267 mm

Length (CL): 350 mm

Width (CW): 212 mm

Packaging:

The packing configuration was enclosed in a carry-bag type packaging, in the form of a plastic bag with a handle. The bag was sized and shaped so as to correspond to the dimensions of the packing configuration as set out in the above. The packing material was a PE mono film having a film thickness of 60 microm.

Transport Package:

Transport package dimensions:

Height (H): 267 mm

Length (L): 350 mm

Width (W): 212 mm

Transport package packing density: 0.30 kg/dm$^3$.

FIGS. 7*a* and 7*b* illustrate different packing configurations each having a packing configuration length CL, width CW and height CH. It will be understood, that with the packaging as described in the above being a plastic bag, the corresponding transport packages' length L, width W and height H will correspond to the measures (CL, CW, CH) of the packing configurations.

FIG. 7*a* illustrates the packing configuration 3 for TP 1 and TP 2. In the packing configuration 3, the stacks 4 is in a configuration L×W×H being 3×1×7, as illustrated.

As seen in FIG. 7*a*, the stacks of the individual packages are arranged in parallel, i.e. with a similar orientation vis avi the dimensions of the packing configuration. Hence, the stack length SL of each stack is parallel to the width W of the transport package 1, the stack width SW is parallel to the height H of the transport package 1, and the stack height SH is parallel to the length L of the transport package 1.

FIG. 7*b* illustrates the packing configuration 3 of the transport package according to TP 3. In this packing configuration 3, a total of 15 stacks are arranged in a L×W×H configuration being 5×1×3, as illustrated in FIG. 7*b*. The relative orientations of the stack dimensions and the transport package dimensions are similar to those described for FIG. 7*a*.

Figure 7C:
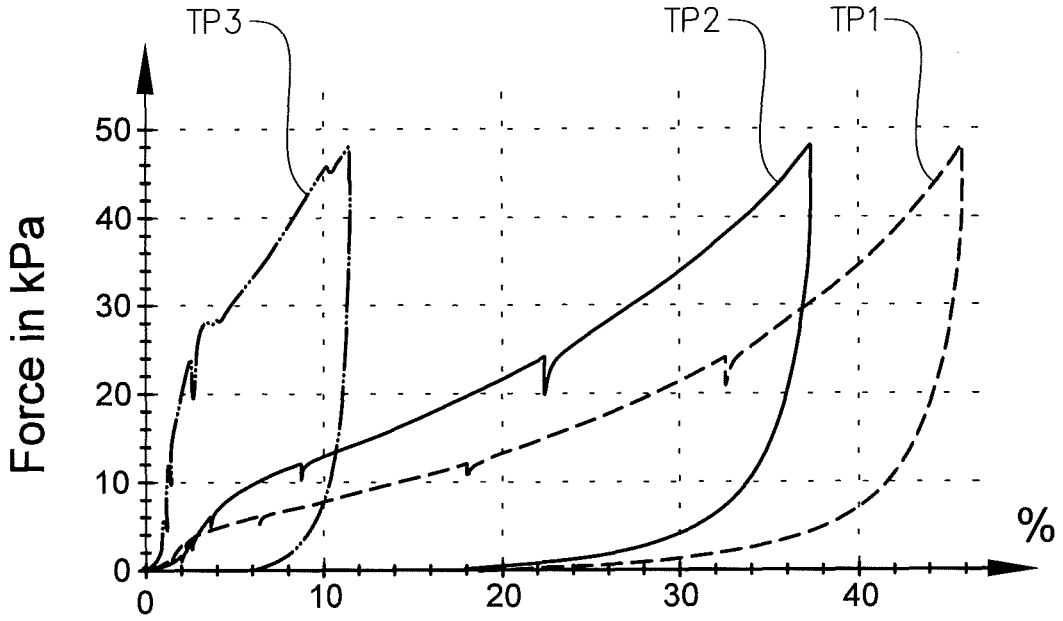

FIG. 7*c* illustrates the results of relative deformation measurements at deformation pressures ranging from 0 to 48 kPa, for the transport packages TP1, TP2 and TP3, respectively, as measured along the height dimension H thereof. It is noted, that for the transport packages TP1, TP2, TP3, this means that the deformation pressure is applied along the stack width dimension SW of the individual stacks.

The relative shortening of the height H of the transport packages TP1, TP2 and TP3 is plotted against the deformation pressures.

As seen from FIG. 7*c*, the relative deformation in the height direction H of TP3 at 15 kPa is less than 10%. Indeed, the relative deformation of TP3 in the height direction H is less than 10% also at 25 kPa deformation pressure, or even 35 kPa deformation pressure. In contrast, at 15 kPa deformation pressure, TP1 displays more than 20% relative deformation, and TP2 about 15%.

Figure 7D:
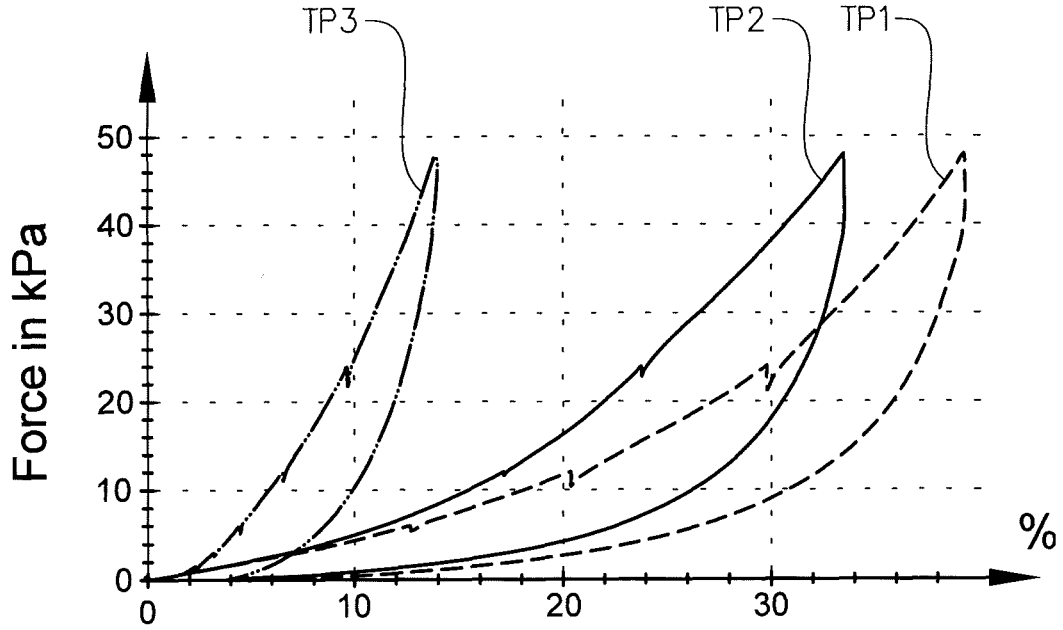
Figure 7E:
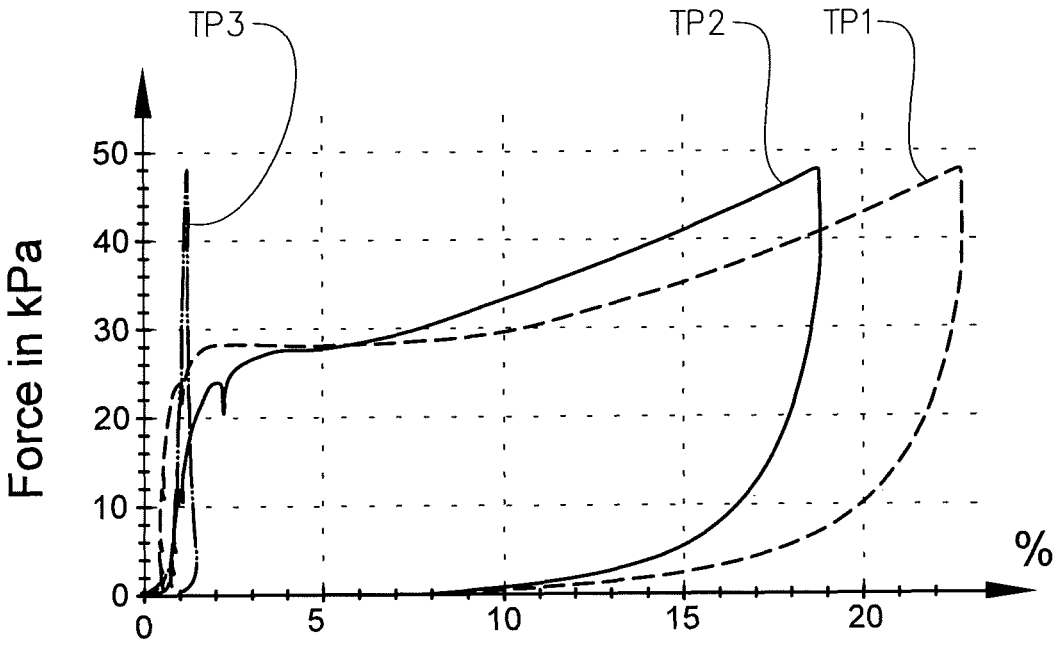
Figure 7F:
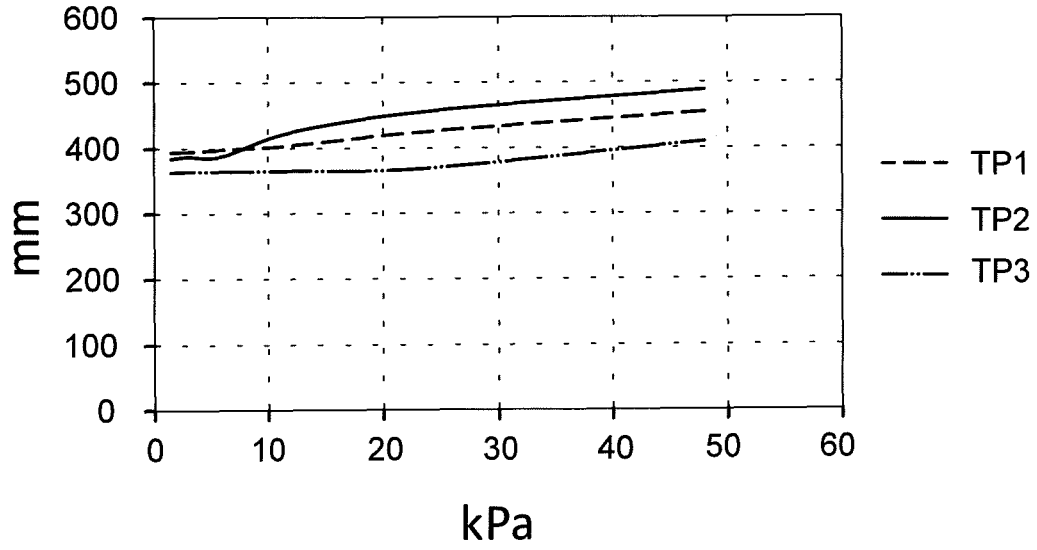

In FIG. 7*f*, the relative elongation of the length dimension L of the transport package is plotted versus the deformation pressure, during the tests performed for FIG. 7*c*. It is seen how the relative elongation remains less than 5% at 15 kPa.

FIG. 7*d* illustrates the results of relative deformation measurements at deformation pressures ranging from 0 to 48 kPa, for the transport packages TP1, TP2 and TP3, respectively, as measured along the length dimension L thereof. It is noted, that for the transport packages TP1, TP2, TP3, this means that the deformation pressure is applied along the stack height dimension SH of the individual stacks.

The relative shortening of the length L of the transport packages TP1, TP2 and TP3 is plotted against the deformation pressures.

As seen from FIG. 7*d*, the relative deformation in the length direction L of TP3 15 kPa is less than 10%. Indeed, the relative deformation of TP3 in the length direction L is less than 10% also at 20 kPa deformation pressure. In contrast, at 15 kPa deformation pressure, TP1 displays more than 20% relative deformation, and TP2 between 15% and 20%.

Figure 7G:
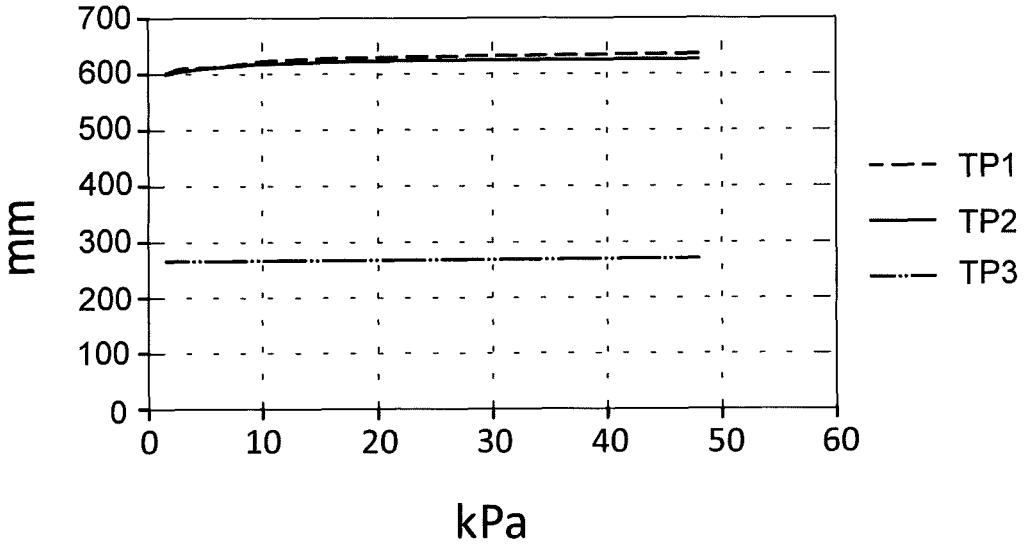

In FIG. 7*g*, the relative elongation of the height dimension H of the transport package is plotted versus the deformation pressure, during the tests performed for FIG. 7*d*. It is seen how the relative elongation remains less than 5% at 15 kPa.

FIG. 7*e* illustrates the results of relative deformation measurements at deformation pressures ranging from 0 to 48 kPa, for the transport packages TP1, TP2 and TP3, respectively, as measured along the width dimension W thereof. It is noted, that for the transport packages TP1, TP2, TP3, this means that the deformation pressure is applied along the stack length dimension SL of the individual stacks.

The relative shortening of the width W of the transport packages TP1, TP2 and TP3 is plotted against the deformation pressures.

As seen from FIG. 7*e*, the relative deformation in the width direction W of TP3 at 15 kPa is less than 10%. Indeed, the relative deformation of TP3 in the width direction W is less than 10% also at 25 kPa deformation pressure, or even 35 kPa deformation pressure. At 15 kPa deformation pressure, it is seen that also TP1 and TP2 displays less than 10% relative deformation.

Figure 7H:
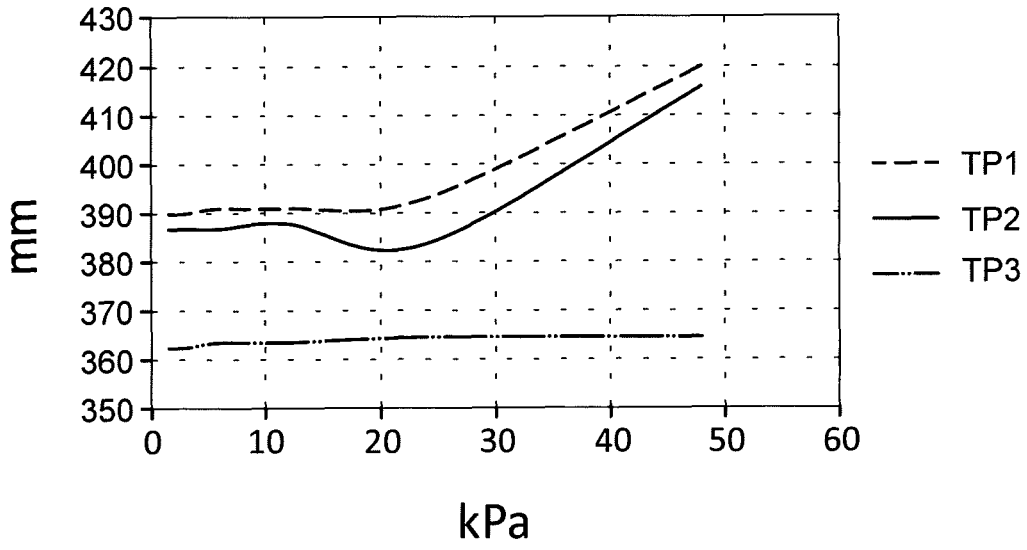

In FIG. 7*h*, the relative elongation of the length dimension L of the transport package is plotted versus the deformation pressure, during the tests performed for FIG. 7*c*. It is seen how the relative elongation remains less than 5% at 15 kPa.

In view of the above, it is understood that the prior art transport packages TP1 and TP2 displays a limited relative deformation along one direction only, namely the width direction W. Accordingly, both TP1 and TP2 should preferably be packed such that loads occurring during packing, transport and storage of the transport packages is primarily directed along the width direction.

TP3 displays a limited relative deformation along all three dimensions, although the width W and the height H dimension display the most limited relative deformation. Accordingly, the transport package TP3 may be packed without concern to the direction in which the loads occurring during packing, transport and storage of the transport packages will appear. If it is desired to resist very high loads, loading along the width W and height H directions are however preferred.

It may be assumed that the limited relative deformation resistance achieved for TP3 is primarily due to the density of the stacks 4 therein being larger than the density of the stacks of TP1 or TP2, which means that the stacks 4 per se should be more stable. However, other features may also be of importance. For example, the manner in which the stacks 4 are arranged inside the packaging 2 may be of importance. Also, in the transport package TP3, the stacks 4 are relatively densely packed, with little or no space between stacks 4.

Method for Determining Relative Deformation

The methodology for a measuring the relative deformation of a transport package is the following:

Description of the Equipment

Figure 6A:
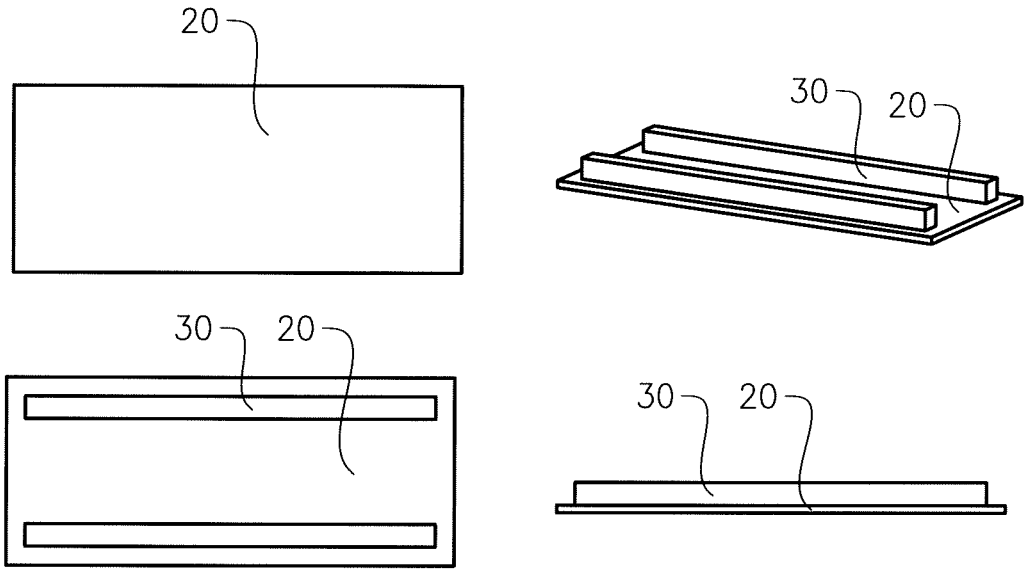
FIGS. 6*a* and 6*b* illustrate the method for determining the relative deformation along a selected dimension of a transport package
Figure 6B:
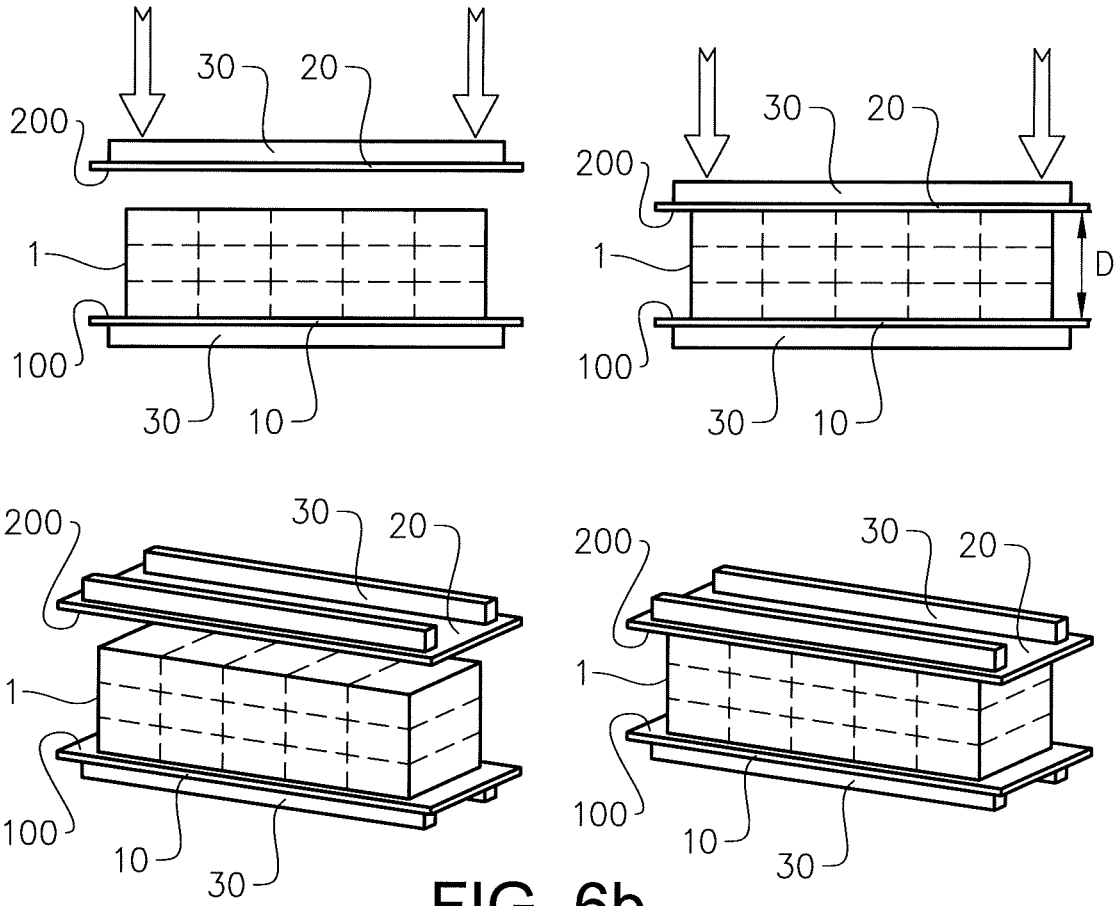

FIGS. 6*a* and 6*b* illustrate schematically the equipment for the relative deformation measurement method.

A universal testing machine, e.g. Z100 supplied by Zwick/Roell, is used with a 50 kN load cell.

The test method comprises compressing the transport package between two essentially parallel, planar pressure surfaces 100, 200.

To provide the pressure surfaces 100, 200, two plywood boards 10, 20 are used.

The two plywood boards 10, 20 provide the same pressure surface area. The pressure surface area of the plywood boards 10, 20 is selected to be larger than the area of the largest outer surface of the transport package 1 to be tested.

The plywood boards 10, 20 shall be of sufficient thickness to ensure that they do not bend when subject to the pressures used in the method, typically minimum 25 mm.

To further secure that the plywood boards do not bend or deform in any way during testing, each board is enforced by a support structure 30, being arranged on the side of the plywood board opposite the pressure surface 100, 200. Typically, the support structure 30 may be formed by two longitudinal beams extending over the full length of the plywood board and in parallel to the length dimension thereof. The two longitudinal beams may be centrally arranged with a transversal distance between them suitable to inhibit deformation of the board.

In the tests performed in relation to FIGS. 7*a* to 7*h*, the plywood boards had the dimensions 800×400×25 mm. The longitudinal beams had the dimensions 800×100×25 mm, and were centrally arranged on the board with a transversal distance between the beams of 200 mm.

However, it is envisaged that different support structures could be used to ensure that the pressure surfaces 100, 200 of the plywood boards 10, 20 which are to be pressed towards the transport package 1 are maintained in a planar condition during testing.

A first plywood board 10 will form a bottom pressure surface 100 on which the transport package 1 will be positioned during testing. To this end, the first plywood board 10 should be stably positioned such that the bottom pressure surface 100 extends in a horizontal plane.

A second plywood board 20 is mounted in the test equipment, so as to be movable in a vertical direction, and such that its pressure surface 200 extends in the horizontal plane. The second plywood board 20 should be arranged such that the extension of its pressure surface 200 corresponds to the extension of the pressure surface 100 of the first plywood board 10.

The test equipment shall be set for compliance correction and so as to remove the thickness of the plywood boards from the results.

Description of Testing Procedure

A dimension D for which the relative deformation of the transport package 1 is to be determined is selected. The transport package is positioned on top of the bottom plywood board 10 such that the selected dimension D of the transport package 1 extends in a vertical direction.

The second, movable plywood board 20 arranged in the testing machine is vertically lowered towards the bottom board of plywood 10, pressing the transport package 1 between the two pressure surfaces 100, 200. The movable board 20 is moved along the vertical direction only, i.e. perpendicular to the extension of the pressure surfaces 100, 200.

The movable plywood board 20 comprising the movable pressure surface 200 is initially lowered at a speed of 50 mm/min, until a force corresponding to a pressure of 0.1 kPa is registered by the test equipment. The distance between the boards at this point (pressure=0.1 kPA) is recorded and is regarded as the initial extension $D_0$ of the transport package at along the dimension D. Hence, the initial extension $D_0$ corresponds to the initial height $H_0$, width $W_0$ or length $L_0$ of the transport package.

Thereafter, the movable plywood board 20 comprising the movable pressure surface 200 is lowered at a speed of 100 mm/min.

The pressure and the distance between the boards in the vertical direction are recorded continuously by the testing machine. For each measured distance $D_1$, the corresponding relative deformation of the transport package 1 in the vertical direction (corresponding to the dimension D of the transport package 1) is calculated as $(D_0-D_1)/D_0$. Accordingly, the relative deformation being the relative shortening along a selected dimension of the transport package at a specific pressure is obtained.

For measuring the simultaneous extension of the transport package in the two other dimensions perpendicular to the selected dimension D, during compression of the transport package along a selected dimension D, the same test equipment as described in the above may be used for compressing the transport package. In this case, the lowering of the upper board is stopped at a number of selected pressures, advantageously at 1.5, 3, 6, 12, 24 and 48 kPa. Each stop lasts for 1 minute, during which measurement of the extension of the transport package along the dimensions perpendicular to the compression dimension D may be made using a sliding caliper, advantageously Mitutoyo 160-104. After each stop, the continuous lowering of the upper board is continued.

The measure $D_1$ of the selected dimension (L, W, H) achieved is compared to the initial length, width or height of the transport package. The initial dimension $D_0$ being the initial length, width or height of the transport package is achieved as described in the above with a pressure of 0.1 kPa towards the relevant dimension. The elongation is determined to be $(D_1-D_0)/D_0$.

Sample Conditioning

Sample transport packages are conditioned during 24 hours to 23° C., 50% RH. The same conditions are present also during performance of the test procedures. A representative amount of samples is tested for each product, typically minimum 5 samples.

It will be understood, that the performance of the test procedure on a sample transport package may alter the properties of the sample transport package. Accordingly, for each test to be performed, a new sample package should be used.

Measurements of a transport package are performed on the entire transport package, including the packing configuration and the packaging.

Measurements to be performed on a packaging only are made on an empty packaging from which the packing configuration has been removed.

Method for Determining the Packing Density of the Transport Package

The packing density of the transport package is to be a measure of the amount of content of the transport package versus its outer dimensions. Accordingly, for determining the packing density, the weight of the packing configuration 3 (content) is to be divided with the volume of the transport package 1.

The volume of the transport package is determined by determining the height H, width W and length L of the transport package using the test procedure as described in the above, and subjecting the transport package to a pressure of 0.1 kPa along the dimension to be measured. The volume of the transport package is hence approximated to H×W×L as measured.

The weight of the packing configuration is determined by first weighing the transport package and then removing the packaging and weighing the packaging alone. The weight of the packing configuration is to be the weight of the transport package minus the weight of the packaging. The measurements may be made using a suitable calibrated scale.

Method for Determining the Stack Density

Density is defined as weight per volume and reported in $kg/dm^3$.

As defined in the above, in the stack of tissue paper material the tissue paper material forms panels having a stack length (SL), and a stack width (SW) perpendicular to the length (SL), the panels being piled on top of each other to form a stack height (SH). The height (SH) extends perpendicular to the length (SL) and width (SW), and between a first end surface and a second end surface of the stack.

The volume of a stack is determined as SL×SW×SH.

Sample stacks are conditioned during 48 hours to 23° C., 50% RH.

Height Determination

For determining the height (SH) of a stack, the stack, including any stack packaging, is positioned on a generally horizontal support surface, resting on one of its end surfaces, so that the height (SH) of the stack will extend in a generally vertical direction.

At least one side of the stack may bear against a vertically extending support, so as to ensure that the stack as a whole extends in a generally vertical direction from the supported end surface.

The height (SH) of the stack is the vertical height measured from the support surface.

A measurement bar held parallel to the horisontal support surface, and parallel to the width (SW) of the stack is lowered towards the free end surface of the stack, and the vertical height of the bar when it touches the stack is recorded.

The measurement bar is lowered towards the free end surface of the stack at three different locations along the length (SL) of the stack. The first location should be at the middle of the stack, i.e. ½ L from each longitudinal end thereof. The second location should be about 2 cm from the first longitudinal end (measured along the length (SL)) and the third location at about 2 cm from the second longitudinal end (measured along the length (SL)).

The height (SH) of the stack is determined to be a mean value of the three height measurements made at the three different locations.

It will be understood, that when the above-mentioned height determination method is performed, and when the stack is not perfectly rectangular but for example the end surfaces bulges outwards, the height will correspond to a maximum height of the stack.

The density to be determined is the density of the stack, and hence the stack packaging is not to be included in the volume or weight measurement.

However, many packaging materials used in the art are rather thin, and their thickness will not affect the measurement significantly. Should a packaging material have a thickness such that the material may significantly include the measurement, the thickness of the stack packaging material may be determined after removal thereof from the stack, and the value achieved during the height measurement procedure may be adjusted accordingly.

Length and Width Determination

The length (SL) and width (SW) of the stack is determined by opening the stack and measuring the length (SL) and width (SW) of the panels of in the stack. Edges and/or folds in the tissue paper material will provide necessary guidance for performing the length (SL) and width (SW) measurements.

Under practical circumstances, it is understood that the length and width of a stack may vary for example during compression and relaxation of the stack. Such variations are however deemed not significant for the density to be determined herein. Instead, the length (SL) and width (SW) of the stack are regarded to be constant and identical to the length (SL) and width (SW) as measured on the panels.

Weight

The weight of the stack is measured by weighing to the nearest 0.1 g with a suitable calibrated scale.

To determine the density of a stack when inside a stack packaging, the stack packaging should naturally be removed before weighing the stack.

It will be realized that numerous embodiments and alternatives are available without departing from the scope of the claims. In particular, different packing configurations may be formed and evaluated so as to achieve the desired limited deformation of the transport package. Also, numerous options are available for forming a suitable packaging.

The invention claimed is:

1. A transport package comprising a compressible packaging and a packing configuration, the compressible packaging being a flexible material, the packing configuration comprising at least three individual stacks of absorbent tissue paper material, wherein each stack of the packing configuration is provided in an individual package of a stack and a stack packaging, wherein the stack packaging is of a flexible material, and said packing configuration consists of the individual packages, the packaging maintaining said individual stacks in said packing configuration, said transport package forming a rectangular parallelepiped delimited by six outer surfaces, defining three transport package extensions extending along three perpendicular dimensions in space defining a length, a width and a height of said transport package, a relative deformation of said transport package being defined for each of said three dimensions, being the relative shortening of the transport package extension along a selected dimension when the entire transport package is compressed with a deformation pressure of 15 kPa between two outer surfaces and along the selected dimension, wherein, for said transport package, the relative deformation along at least two out of said three dimensions is less than 10%, and wherein the absorbent tissue paper material of at least one of said individual stacks of said packing configuration contributes to limiting said relative deformation.

2. The transport package according to claim 1, wherein the tissue paper material of at least 50% of said individual stacks in said packing configuration contributes to limiting said relative deformation.

3. The transport package according to claim 1, wherein said relative deformation along said at least two out of said three dimensions is less than 5%.

4. The transport package according to claim 1, wherein, a relative deformation of the transport package along a third dimension is defined by the relative shortening of the transport package extension along said third dimension when the entire transport package is compressed with a deformation pressure of 15 kPa between two outer surfaces and along said third dimension, said relative deformation being less than 15%.

5. The transport package according to claim 1, wherein, for each relative deformation along a selected dimension, at a deformation pressure of 15 kPa, a maximum elongation is defined being the maximum relative lengthening of the transport package extensions perpendicular to said selected dimension along which the transport package is compressed at 15 kPa, said maximum elongation being less than 5%.

6. The transport package according to claim 1, wherein said packaging is such that, when said transport package is compressed along a selected dimension with a deformation pressure of 15 kPa, the packaging is maintained in an intact condition.

7. The transport package according to claim 1, wherein said packaging comprises disposable material.

8. The transport package according to claim 1, wherein said packaging is collapsible.

9. The transport package according to claim 1, wherein said packaging is non-collapsible.

10. The transport package according to claim 1, wherein a relative deformation of said transport package as measured when the entire transport package is compressed with a deformation pressure of 25 kPa between two outer surfaces and along the selected dimension, is less than 10%, along at least two out of said three dimensions.

11. The transport package according to claim 1, wherein said packing configuration forms a rectangular parallelepiped delimited by six outer surfaces, generally corresponding to said rectangular parallelepiped formed by said transport package.

12. The transport package according to claim 1, wherein said stack packaging is collapsible.

13. The transport package according to claim 4, wherein, in each individual stack, said absorbent tissue paper material forms panels having a stack length and a stack width, perpendicular to said stack length, said panels being piled on top of each other to form a stack height.

14. The transport package according to claim 13, wherein, in said packing configuration of said transport package, at least two individual stacks in said transport package are arranged with their respective stack lengths extending in parallel to different transport package extensions.

15. The transport package according to claim 13, wherein, in said packing configuration of said transport package, at least 50% of said individual stacks are arranged with their respective stack lengths extending in parallel to the same transport package extension.

16. The transport package according to claim 13, wherein, in said packing configuration, less than 50% of the individual stacks are arranged with their respective stack lengths extending in parallel to one of said dimensions displaying said relative deformation.

17. The transport package according to claim 13, wherein, in said packing configuration, less than 50% of said individual stacks are arranged with their respective stack lengths extending in parallel to said third dimension.

18. The transport package according to claim 13, wherein, in said packing configuration, at least 50% of said individual stacks are arranged with their respective stack heights extending in parallel to said third extension.

19. The transport package according to claim 1, wherein said absorbent tissue paper material comprises a dry crepe material, a structured tissue material, a wet crepe material, or a combination material comprising at least two of the afore-mentioned materials.

20. The transport package according to claim 1, wherein said stacks have a stack density of at least 0.20 kg/dm3.

21. The transport package according to claim 1, wherein said transport package has a packing density of at least 0.20 kg/dm3.

22. A method for forming a transport package according to claim 1, said transport package comprising at least three individual stacks of absorbent tissue paper material, said method comprising:

selecting a compressible packaging, arranging said individual stacks in a packing configuration, and arranging said compressible packaging so as to maintain said packing configuration to form said transport package.

* * * * *